US012076655B2

(12) United States Patent
Hoenigschmid

(10) Patent No.: US 12,076,655 B2
(45) Date of Patent: Sep. 3, 2024

(54) TRANSFORMATIONAL TOY

(71) Applicant: Andreas Hoenigschmid, Los Angeles, CA (US)

(72) Inventor: Andreas Hoenigschmid, Los Angeles, CA (US)

( * ) Notice: Subject to any disclaimer, the term of this patent is extended or adjusted under 35 U.S.C. 154(b) by 0 days.

(21) Appl. No.: 18/257,915

(22) PCT Filed: Dec. 16, 2021

(86) PCT No.: PCT/IB2021/061868
§ 371 (c)(1),
(2) Date: Jun. 16, 2023

(87) PCT Pub. No.: WO2022/130285
PCT Pub. Date: Jun. 23, 2022

(65) Prior Publication Data

US 2023/0398430 A1 Dec. 14, 2023

Related U.S. Application Data

(60) Provisional application No. 63/126,074, filed on Dec. 16, 2020.

(51) Int. Cl.
*A63F 9/08* (2006.01)

(52) U.S. Cl.
CPC ..... *A63F 9/088* (2013.01); *A63F 2009/0884* (2013.01)

(58) Field of Classification Search
CPC ..... A63F 9/088; A63F 2009/0884
See application file for complete search history.

(56) References Cited

U.S. PATENT DOCUMENTS 3,596,396 A * 8/1971 Thomson ..... A63F 9/088 428/542.2
3,662,486 A * 5/1972 Freedman ..... A63F 9/088 273/155
4,142,321 A * 3/1979 Coppa ..... A63H 33/16 428/542.2

(Continued)

FOREIGN PATENT DOCUMENTS

CN 218589651 U * 3/2023
DE 7005541 U 5/1970

(Continued)

OTHER PUBLICATIONS

International Search Report and Written Opinion of the International Searching Authority mailed on Mar. 25, 2022, issued in the corresponding International Application No. PCT/IB2021/061868, filed on Dec. 16, 2021, 9 pages.

*Primary Examiner* — Steven B Wong
(74) *Attorney, Agent, or Firm* — IPkey PLLC; Kyle E. Yarberry; John W. Zerr

(57) ABSTRACT

A transformational toy comprises at least six polyhedron bodies, at least one connection strip for connecting the polyhedron bodies in a chain, wherein the connection strip provides hinges between every pair of adjacent polyhedron bodies of the chain, wherein the hinges facilitate movement of the polyhedron bodies between at least two different geometric transformations of a combined body of all polyhedron bodies, wherein at least one of the connection strips is connecting at least three adjacent polyhedron bodies.

13 Claims, 19 Drawing Sheets

(56) References Cited

U.S. PATENT DOCUMENTS 4,633,607 A * 1/1987 Brasch ..... G09F 1/06 40/539
4,722,712 A * 2/1988 McKenna ..... A63H 33/108 446/99
4,875,681 A * 10/1989 Ofir ..... A63F 9/088 446/119
5,108,100 A * 4/1992 Essebaggers ..... A63F 9/12 273/159
5,299,804 A * 4/1994 Stevens ..... A63F 9/088 446/487
5,322,284 A * 6/1994 El-Agamawi ..... A63F 9/088 273/159
6,264,199 B1 * 7/2001 Schaedel ..... A63F 9/088 273/157 R
8,061,713 B2 * 11/2011 Cook ..... A63F 9/1204 273/156
10,569,185 B2 2/2020 Hoenigschmid
11,524,222 B2 * 12/2022 Kunihiro ..... A63F 9/0826
11,697,058 B1 * 7/2023 Hoenigschmid ..... A63H 33/046 273/155
2012/0049450 A1 * 3/2012 Agamawi ..... A63F 9/0869 273/153 S
2016/0074765 A1 3/2016 Hoenigschmid
2022/0047960 A1 2/2022 Hoenigschmid

FOREIGN PATENT DOCUMENTS

DE 9100132 U 7/1991
EP 1077075 A2 2/2001
FR 2614210 A * 10/1988 ..... A63F 9/088
GB 2107200 A 4/1983
GB 2353226 A * 2/2001 ..... A63F 9/088
WO 92/11911 A1 7/1992
WO WO-2004096393 A2 * 11/2004 ..... A63F 9/088
WO 2005118093 A1 12/2005

* cited by examiner

TRANSFORMATIONAL TOY

CROSS-REFERENCES TO RELATED APPLICATIONS

This application is a National Stage of International Application No. PCT/IB2021/061868, filed Dec. 16, 2021, which claims the benefit of U.S. Provisional Patent Application No. 63/126,074, filed Dec. 16, 2020, the disclosure of each of which is hereby incorporated by reference in its entirety.

TECHNICAL FIELD

The present invention concerns a transformational toy, comprising at least six polyhedron bodies, which allows for forming different geometrical transformations.

PRIOR ART

Geometric toys are also known as geometric puzzles, such as Rubrik's famous cube. The aim of such a toy is to bring order into a set of a specific geometrical objects, where the possible order operations are limited by a set of degrees of freedom. Rubrik's cube for example allows the rotation of a layer of cuboidal cells around a specific rotational axis as order operations.

There are also geometrical toys such as shown in U.S. Pat. No. 10,569,185 B2. In this specific geometric toy, tetrahedron bodies can be rotated around an axis, which is provided by a hinge between adjacent tetrahedron bodies. As every tetrahedron body is coupled to at least to two other tetrahedron bodies, a seemingly simple transformation of a single tetrahedron body around a specific axis leads to the transformation of a plurality of coupled tetrahedron bodies. The aim of such geometrical toys is to transform the initial shape of the toy into different possible shapes.

In the aforementioned prior art the tetrahedrons are coupled to each other using flexible adhesive films, which renders the geometrical toy difficult to manufacture.

DESCRIPTION OF THE INVENTION

Based on the known prior art, it is a task of the present invention to provide an improved transformational toy.

The task is solved by a transformational toy with the features of claim 1. Advantageous further embodiments are shown with respect to the dependent claims, the figures as well as the present specification.

Accordingly, a transformational toy is proposed, comprising at least six polyhedron bodies, at least one connection strip for connecting the polyhedron bodies in a chain, wherein the connection strip provides hinges between every pair of adjacent polyhedron bodies of the chain, wherein the hinges facilitate movement of the polyhedron bodies between at least two different geometric transformations of a combined body of all polyhedron bodies, at least one magnet placed inside each of the polyhedron bodies to maintain the combined body in each of the at least two different transformations, wherein at least one of the connection strips is connecting at least three adjacent polyhedron bodies, therewith forming a hinge between every pair of adjacent polyhedron bodies.

A transformational toy is understood to present a plurality of geometrically defined units which are connected in a specific way, where the arrangement of the plurality of geometrically defined units relative to each other can be geometrically transformed to constitute different overall geometric shapes. For example, a first overall geometrical shape of the transformational toy may be a pyramid and a second overall geometrical shape may be a cube and a third overall geometrical shape may be a star-shaped body. All of the aforementioned shaped can be generated from the same set of geometrically defined units by moving them in a predetermined manner. In the following, the different overall geometric shapes are also referred to as different transformations of the toy. In other words, the pyramid may be transformed into the cube or the star-shaped body which are consequently transformations of the pyramid—which is a transformation in itself.

Each geometrically defined unit is a polyhedron body. A polyhedron body is a three dimensional shape with flat polygonal faces and straight edges. A polygonal face comprises n corner points, where adjacent corner points are connected with a line, which is also called an edge of the polygonal face. The polygonal faces connect to adjacent polygonal faces via the edges of the polygonal faces. A polyhedron body is further closed, such that a three dimensional volume can be enclosed in a required plurality of polygonal faces.

For example, a cube is a polyhedron body. A cube is a six-sided polyhedron body with, where every polygonal face is quadratic. For example, a pyramid is a polyhedron body. A pyramid has a polygonal base, for example a triangular base or a quadratic base and a so called apex, which is the point to which all corner points of the polygonal base connect. Hence two adjacent corners of the base and the apex form a triangle. For example, a tetrahedron is a polyhedron body. A regular tetrahedron is a four-sided polyhedron body with 6 straight edges, where every edge has the same length.

The polyhedron bodies are connected by a connection strip. The connection keeps the polyhedron bodies in a preferred geometric configuration. A further task of the connection strip is to provide hinges between the polyhedron bodies. A hinge between polyhedron bodies allows the polyhedron bodies to move along the degree of freedom which is provided by the hinge.

For example a point-like hinge can provide a rotational degree of freedom in all three space dimensions to the polyhedron body, such that the polyhedron body can be rotated around every angle of the hinge. During this transformation the distance between the corner points of the polyhedron body and the hinge is constant. In particular, a hinge can also provide a rotational degree of freedom around a rotational axis. The movement of the polyhedron body is then limited to a single rotational angle.

When a second polyhedron body is moved around the degree of freedom of a first hinge between a first polyhedron body and the second polyhedron body, while the second polyhedron body is also coupled to a third polyhedron body via a second hinge, then the orientation of the coupled polyhedron bodies cannot be adjusted independently of each other. Hence, a geometric transformation—in particular a rotation around an edge of a polynomial face of the polyhedron body—results in a geometric transformation of the plurality of coupled polyhedron bodies and thus to a transformation of the transformational toy from a first geometric transformation to a second geometric transformation.

The connection strip furthermore connects the polyhedron bodies in a chain, i.e. the polyhedron bodies are connected to at most two neighboring polyhedron bodies.

By connecting at least three of the polyhedron bodies by means of the connection strip, manufacture of the transformational toy can be improved as the number of parts can be reduced.

The geometric transformations can be stabilized, i.e. every polyhedron body maintains its current position relative to its neighboring polyhedron bodies, by using magnetic fields.

A static magnetic field can be generated by a magnet, where the magnetic field reaches through at least one polynomial face of each polyhedron body, and couples to the magnetic field of a second magnet from a second polyhedron body. If the polarization of the magnets result in an attractive magnetic force, then the polyhedron bodies are fixed to each other, which stabilizes the geometric transformation. However, if the magnetic force is repellent then the geometric transformation cannot be stabilized.

The magnets can be fixed to the polyhedron bodies, such that the static magnetic field through the polynomial face of the polyhedron body also remains fixed under geometric transformations. However, the magnets can also be movably connected to the polyhedron bodies. In particular, a movable connection allows shifting and/or sliding and/or rotating, and/or the like of the magnets. In this way, each moving magnet exhibits a given polarity through two or more polygonal faces of a polyhedron body, in two or more directions. For example, the moving magnet of a first polyhedron body is configured to move in response to the presence of a nearby magnetic field of the magnet of a second polyhedron body. The moving magnet will then automatically align in an energetically favorable orientation to the magnetic field of the second polyhedron body, which results in an attractive force between the magnets, which stabilizes the geometric transformation. However, for another geometric transformation the magnetic field through the polygonal face of the polyhedron body might be different, such that the magnetic field can align along two or more directions.

Each moving magnet can thus advantageously simulate a plurality of fixed magnets (non-moving magnets). For example, in some transformational toys having only twelve polyhedron bodies, each polyhedron body includes only a single moving magnet, i.e., twelve total moving magnets in the transformational toy. Due to the movement of each moving magnet, such embodiments advantageously simulate the functionality of geometric art toys having 24, 36, or another number of fixed magnets. This results in reduced production costs and a simplified manufacturing procedure.

All polyhedron bodies of the transformational toy can be connected in a closed loop configuration by the connection strip, forming a kaleidocycle.

A closed loop configuration herby means, that such a transformational toy can be built from a set of polyhedron bodies, which are initially oriented along the connection strip. When both ends of the connection strip are connected together, the connection strip together with the attached polyhedron bodies, builds a loop like structure.

A kaleidocycle is a flexible polyhedron body, which can be twisted around its ring axis. The ring axis is given hereby by the loop of the configuration. All polyhedron bodies can be rotated clockwise or counterclockwise around the loop of the configuration. In this way a continuous transformation of the kaleidocyle will result in the initial geometric configuration after a finite number of transformation steps.

A single connection strip can be provided for connecting all polyhedron bodies.

Using a single strip may be advantageous to reduce shear forces, in particular relative to the embodiments of the prior art according to which the polyhedrons are connected by stickers or film attached to the outsides of the polyhedrons. By using the internal connection strip the resulting hinge is less prone to shear forces as well as fitter to receive the torque applied during transformations.

This has the advantage that the connection strip can be produced in one production step. The connection strip can then be used as a base to which all polyhedron bodies can be attached, which simplifies the production of the transformational toy.

Preferably, the single connection strip has a beginning portion and an end portion which are connected to one another to form a continuous loop. In this manner a relatively simple to manufacture connection strip can be used which can be made of a flat material. Nevertheless, the single connection strip can be used to form a closed loop configuration of all polyhedron bodies for the transformational toy.

In a preferred embodiment the beginning portion and the end portion are shaped such that they can be placed on top of each other to form the continuous loop of the connection strip. This leads to a very efficient way of manufacturing the transformational toy while maintaining the stability of all hinges.

In an alternative embodiment the beginning portion and the end portion are shaped to be placed next to each other to form the continuous loop of the connection strip. In this embodiment it is possible to avoid doubling up material when connecting the two ends of the connection strip such that the feeling of all hinges will be the same.

Instead of a single strip, at least two strips running essentially in parallel can be used to connect at least three polyhedron bodies. Using more than one strip running in parallel may reduce the amount of material provided between the polyhedrons such that the polyhedrons may transition more smoothly between transformations. By the same token, the robustness of the connection between every two polyhedrons can be improved, in particular when the two strips are dimensioned to be redundant.

Each polyhedron body may be composed of two connectable parts and the connection strip is placed between the connectable parts. In other words, the connection strip continues through the polyhedron bodies on their inner side. The hinges are, thus, very stable as they are located exactly in the position where they are geometrically intended and shear forces on the hinges are reduced to the greatest possible extent.

The connectable parts can be an inner part and an outer part or an upper and a lower part, where the terms inner and outer or upper and lower refer to the position of the connectable parts when the transformational toy is in its closed or initial state.

By placing the connection strip between the connectable parts, the connectable parts can be fixed to the connection strip, and the connectable parts can be connected to each other as well. Due to the fixation, the polyhedron bodies are not allowed to perform any translational movement along the connection strip. The only allowed movement is given by the degree of freedom which is provided by the formed hinges between the connection edges of the adjacent polyhedron bodies.

By the connection of the connectable parts to the connection strip a very precise positioning can be achieved and can be maintained for all polyhedron bodies such that a very precise manufacture of the transformational toy can be achieved.

As the connection strip can be placed inside the volume of the polyhedron bodies, the connection strip is mostly hidden and invisible to the user.

A hinge between a first and a second polyhedron body can be formed by inserting a first half of a first portion of the connection strip between the two connectable parts of the first polyhedron body and a second half of the first portion of the connection strip between the two connectable parts of the second polyhedron body, so that the connecting edge of the first polyhedron body and the connecting edge of the second polyhedron body lie adjacent to each other and are pivotably connected by the first portion of the connection strip.

The connection strip hereby comprises different portions, where at least two polyhedron bodies can be attached to every portion. Every portion can be divided into a first half and a second half of the portion, where a first polyhedron body can be attached to a first half of the portion and a second polyhedron body can be attached to a second half of the portion. In this way the connection strip allows to connect the polyhedron bodies into a chain-like structure, while it also provides a pivotable connection of the polyhedron bodies, i.e. the polyhedron bodies can be rotated around the edge of a polynomial face of the polyhedron body, which falls together with the connection strip.

Two connectable parts of the polyhedron body can exhibit cavities for placing the at least one magnet.

This allows to provide a magnet which generates a magnetic field in order to stabilize the geometric transformations of the transformational toy, i.e. the polyhedron bodies maintain their position. In this way an achieved geometric transformation of the toy can be shown to other people, as the transformational toy can be handed form one user to another without destroying the achieved order.

Preferably, the location of the cavity is chosen in such a way that the center orientation of the magnetic field lies in the center of the polyhedron body. This can stabilize the geometric transformation as it can avoid any additional torque on the polyhedron body.

The two connectable parts of the polyhedron body exhibit pins and holes for fixing the two connectable parts to each other.

To connect the connectable parts, the pins are inserted into the holes of the respective connectable part. A connectable part can comprise pins and holes where the corresponding connectable part comprises holes and pins in the corresponding positions.

By means of the pins a very precise positioning of all connectable parts to the connection strip can be achieved.

The parts can be glued together or the pins and the holes hold the connectable parts together by friction. It is also possible that the pins are held in place using a hook or a barb and a protrusion of the hole, where the hook and the protrusion form a snap-in connection.

In this way the transformational toy is mechanically stable, and the unintended destruction of the toy during usage is prevented.

The polyhedron bodies can be formed by 3D-printing, which allows to print the pins and cavities of the polyhedron bodies in a single step. The polyhedron bodies can also be made of a plastic or a hard cardbox, or a composite materials or machined metal.

By using the different surface characteristics of the different materials, such as reflection and color, a special optical appearance of the toy can be achieved. This can help to remember specific geometric transformations, but can also introduce optical symmetries, which make specific geometric transformations of the toy look very pleasing to the eye of the user.

The polyhedron bodies may be tetrahedrons.

A tetrahedron comprises four triangular faces, six edges and four corners. The edges can have different dimensions. A special case where all edges have the same length is the so-called regular tetrahedron.

With a plurality of tetrahedrons it is possible to completely fill a certain given polyhedron body volume, where the volume itself has polynomial faces.

As polyhedron bodies, twelve tetrahedrons can be provided and twelve hinges can be provided to connect the tetrahedrons.

Twelve tetrahedrons can for example be easily obtained from a cube, when a set of cuts along the diagonal planes of the cube are performed, as shown later.

The polyhedron bodies can may be convex.

A polyhedron body is convex, when two points in the polyhedron body volume can be connected by a line, where all points of the line are also contained in the polyhedron body.

For example a cube, a tetrahedron and all Platonic solids are convex polyhedron bodies. For example a U-shaped tube is not convex as a point in the first part of the "U" and a point of the second part of the "U" cannot be connected to each other without leaving the U-shaped volume.

All polyhedron bodies may have an identical shape and size.

This has the advantage that the production of the transformational toy is simplified as the number of different parts is reduced.

For example, all polyhedron bodies are tetrahedrons where the edge lengths of the base triangle are $\sqrt{2}$, 1, 1 and where all other three edges of the tetrahedron have the length of $\sqrt{3}/2$.

BRIEF DESCRIPTION OF THE FIGURES

Preferred further embodiments of the invention are explained in detail in the following description of the Figures. It is shown.

DETAILED DESCRIPTION OF PREFERRED EMBODIMENTS

In the following, preferred embodiments are described by means of the Figures. The same, similar or similar-acting elements in the different Figures are identified by identical reference signs, and a repeated description of these elements is partly omitted to avoid redundancies.

Figure 1B:
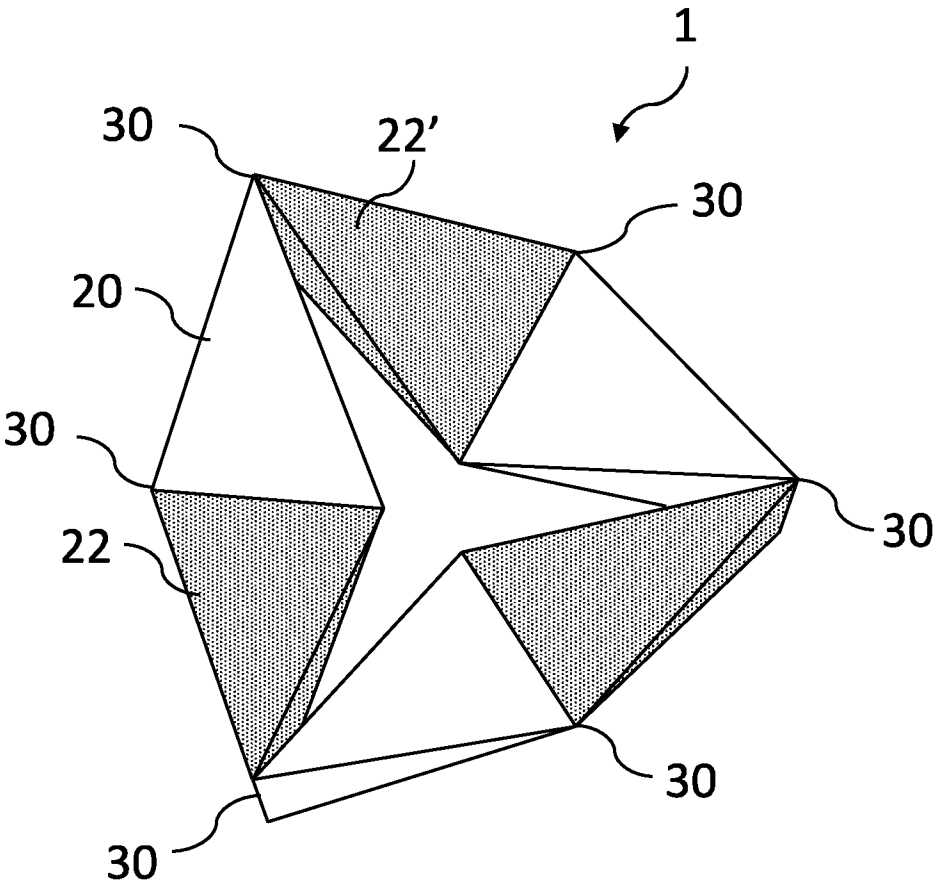
FIG. 1A, B, C, D schematic drawing of a first embodiment in a first and second geometric configuration.
Figure 1A:
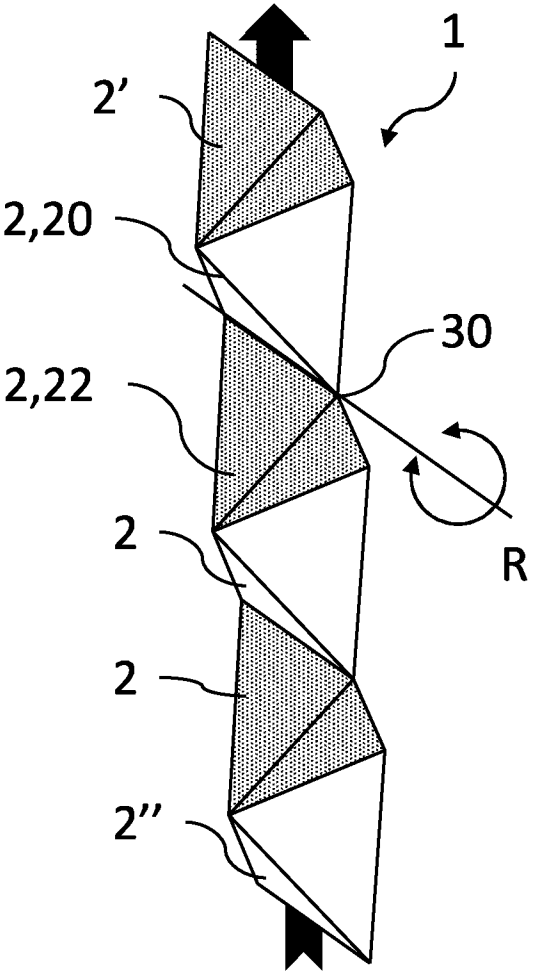

In FIG. 1A, a transformational toy 1 is schematically shown in a first geometric configuration.

The transformational toy 1 of this embodiment comprises six polyhedron bodies 2. In this embodiment, all faces of the polyhedron bodies 2 are provided as flat, isosceles triangles. In case each face of a polyhedron body 2 is shaped as an equilateral triangle, such a polyhedron body 2 would also be referred to as a regular tetrahedron.

Each polyhedron body 2 is connected to at least one other polyhedron body 2', where the connection between adjacent polyhedron bodies 20, 22 is provided by a connection strip 3 (described below) to which the polyhedron bodies 2 are fixed. In such a configuration, an edge of a first polyhedron body 20 and an edge of an adjacent polyhedron body 22 lie next to each other while the connection strip 3 serves as a hinge 30 between the two polyhedron bodies 20, 22. Hence, due to the presence of the hinge 30 the first polyhedron body 20 can be rotated around the edge of the adjacent polyhedron body 22 and vice versa. The rotation is facilitated by the hinge 30 and results in a rotation about a rotation axis R which is typically situated parallel to the adjacent edges of neighboring polyhedron bodies 20, 22.

This requires the connection strip 3 to be at least partially flexible, facilitating the rotation of the polyhedron bodies 20, 22 relative to one another.

The connection strip 3 may connect at least three of the polyhedron bodies 2, preferably all of the polyhedron bodies 2, in a chain-like fashion as is shown in the embodiment of FIG. 1A. In the embodiment of FIG. 1A the chain of the polyhedron bodies 2 is not closed such that the polyhedron bodies 2 form a linear succession of geometrical bodies. The polyhedron bodies 2 are rotatable with respect to one another about their respective rotation axes R which are situated between two adjacent polyhedron bodies 2.

In FIG. 1B another geometric configuration of the transformational toy 1 of FIG. 1A is schematically shown. This second geometric configuration, which is a closed loop configuration, is obtained by connecting the upper polyhedron body 2' with the lower polyhedron body 2" of FIG. 1A. This option for providing a closed configuration is schematically shown by the black arrow in FIG. 1A.

Figure 1D:
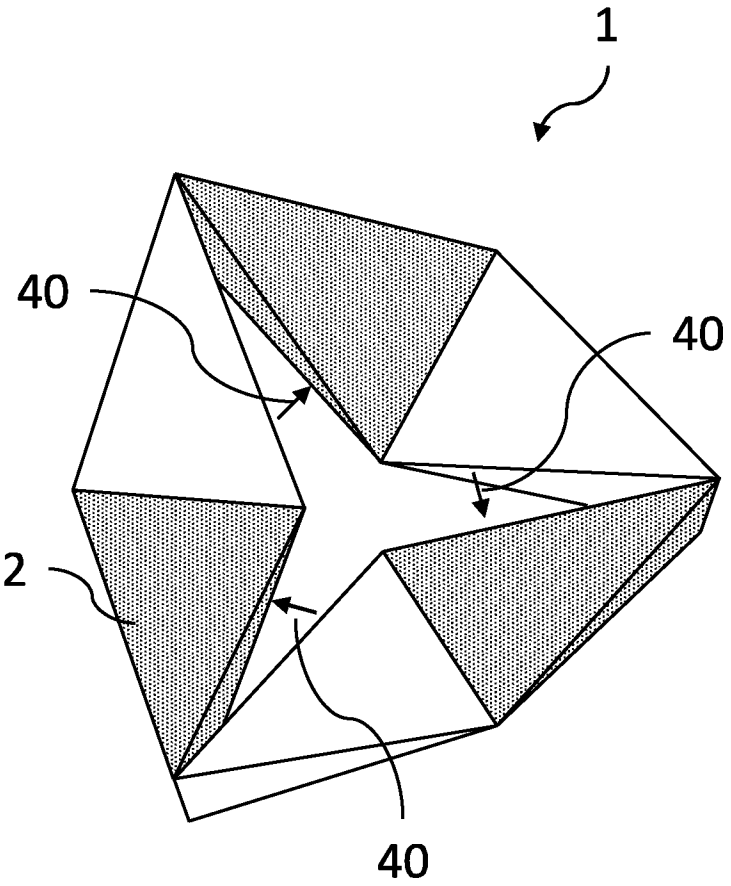
Figure 1C:
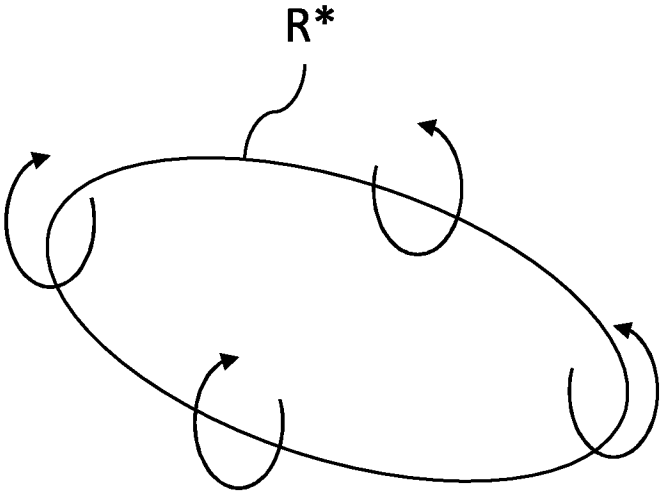

The geometric configuration forms a kaleidocycle which can be twisted around its ring axis R* (see FIG. 1C). By continuous twisting of the kaleidocycle around the ring axis R* it is possible to subsequently move all four sides of the polyhedron bodies 2 to the top surface. The different arrangements of the respective sides of the polyhedron bodies 2 in the ring are referred to as different transformations.

In FIG. 1C the twisting motion is schematically shown. The polyhedron bodies 2 are turned about the ring axis R* in such a way that every polyhedron body 2 is locally rotated clockwise (or counterclockwise) about the ring axis R*. By twisting the polyhedron bodies 2 about the ring axis R*, different transformations of the geometric configuration can be obtained.

The transformational toy 1 can be stabilized in its different geometric transformations as shown in FIG. 1D.

Figure 5A:
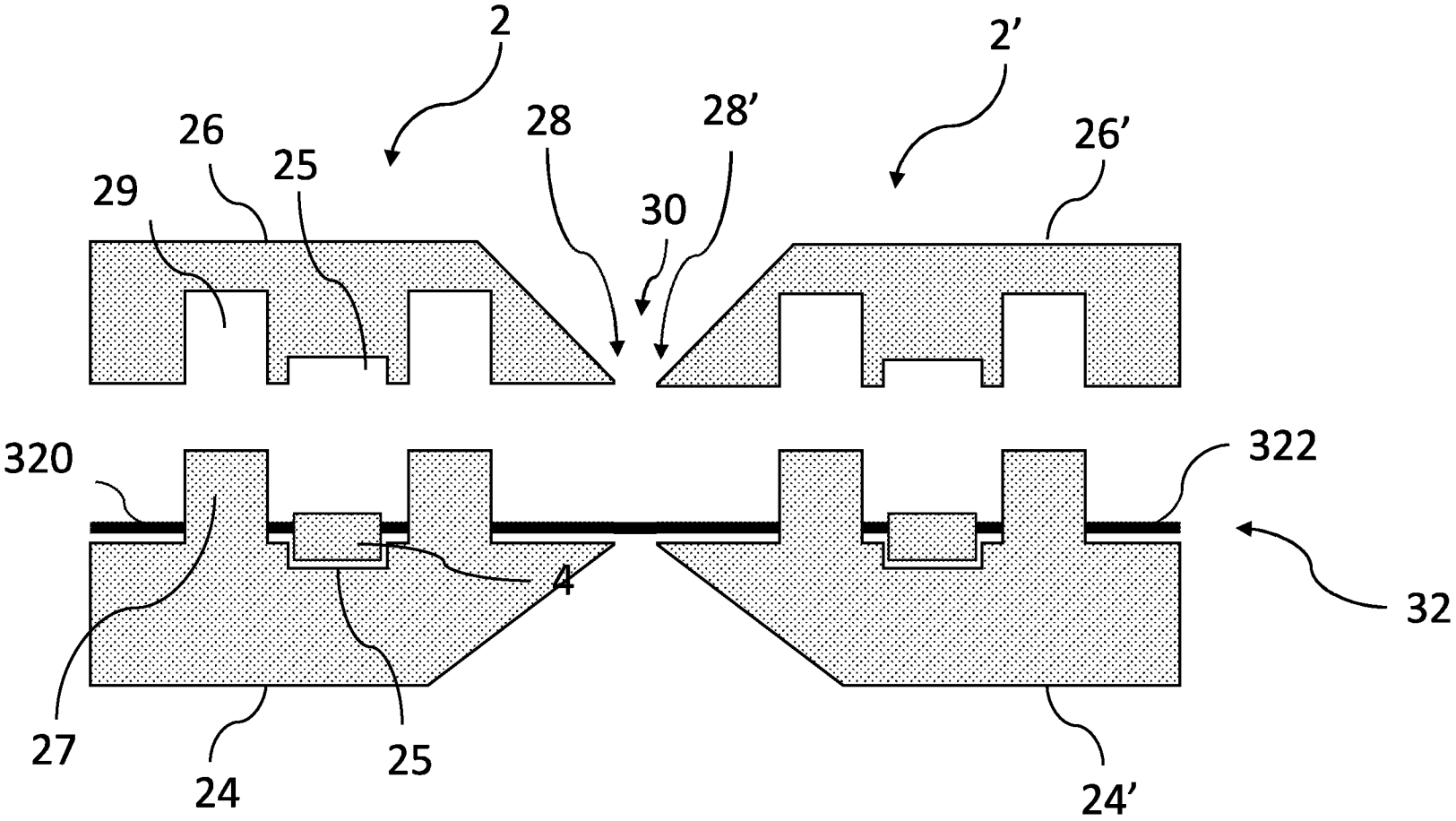
FIG. 5A, B, C, D, E, F schematic drawing of the attachment of a polyhedron body to the connection strip.

Every polyhedron body 2 may comprise at least one magnet (located inside the polyhedron bodies 2 and shown, for example, in the cross-section of FIG. 5A at reference numeral 4), which produces a magnetic field 40. By arranging the magnets accordingly, the magnetic fields 40 are oriented in such a manner that adjacent polyhedron bodies 20, 22 can be attracted to each other when the magnets 4 of the adjacent polyhedron bodies 20, 22 have an attractive polarity. If the magnets have a repulsive polarity, the polyhedron bodies 2 cannot be stabilized in the specific transformation.

Figure 2A:
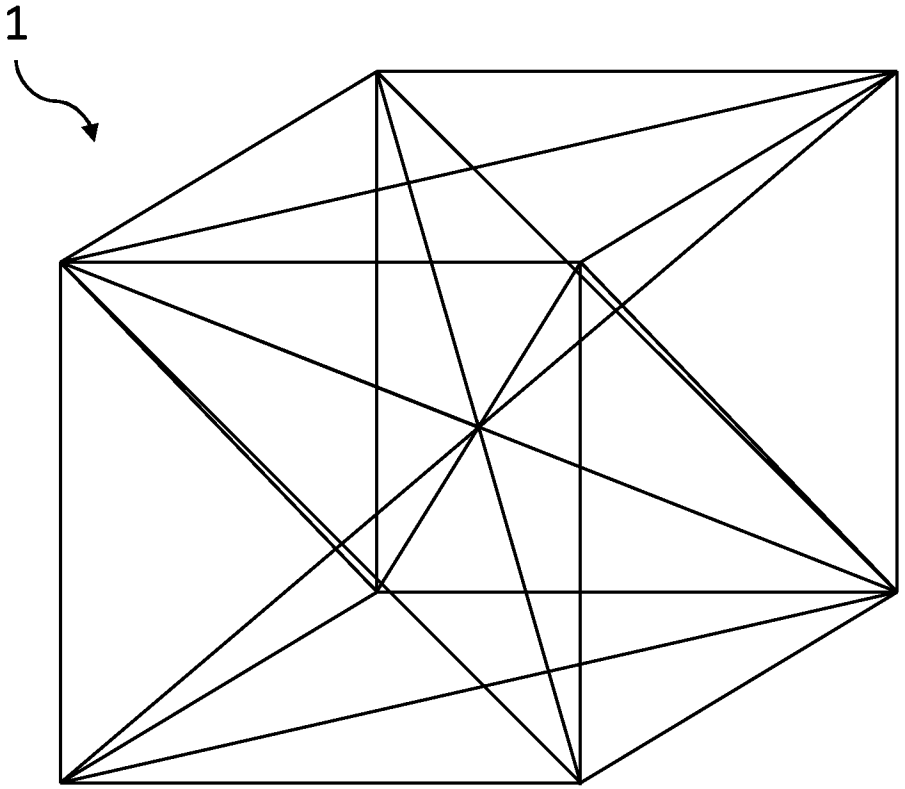
FIG. 2A, B, C, D, E, F, G, H, I, J, K schematic drawing of a second embodiment in different geometric configurations.

In FIG. 2A another transformational toy 1 is shown. The transformational toy 1 comprises twelve identical polyhedron bodies 2 and twelve hinges 30, which in a first geometric transformation form a cube.

Figure 2C:
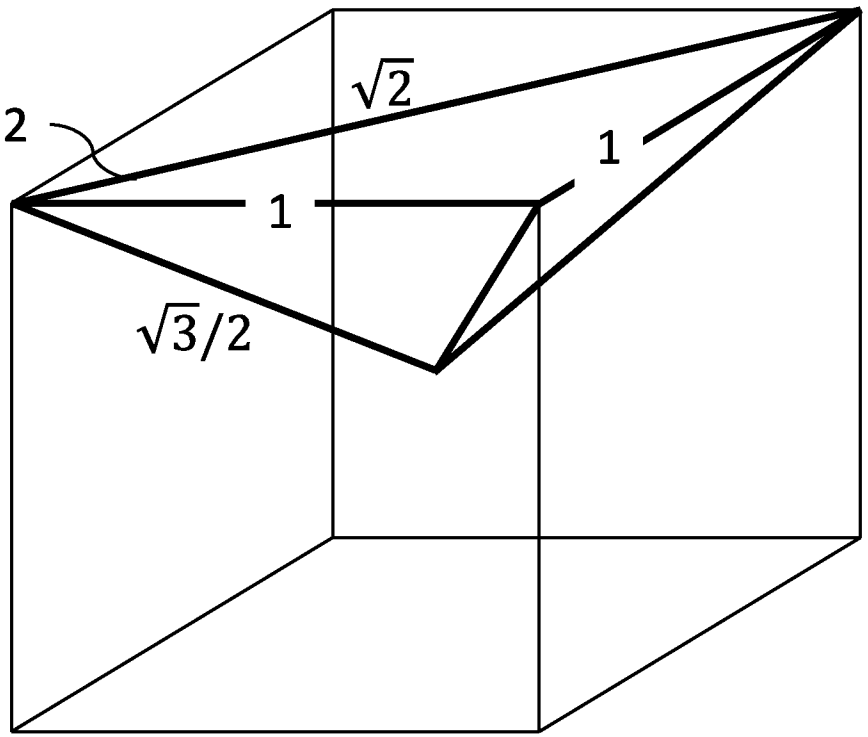
Figure 2B:
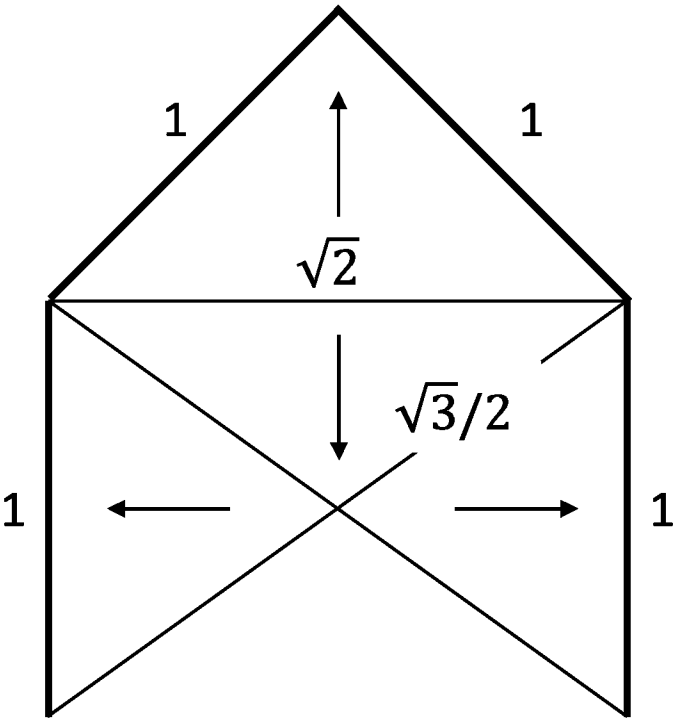

Each polyhedron body 2 may be obtained from a polygon net shape as shown in FIG. 2B. The shape consists of an upper isosceles rectangular triangle, where two sides have similar length, e.g. unit length 1. The base of the isosceles triangle thus has a length of $\sqrt{2}$ unit lengths. This base is also the base of another isosceles triangle, which has however two sides with a similar length of $\sqrt{3}/2$ unit lengths. Each side of the lower base triangle, however, is also the side of two isosceles side triangles, which have again a base length of 1 unit length.

When the outer sides of the shape are folded together a polyhedron body 2 as shown in FIG. 2C can be obtained.

The polyhedron bodies 2 can also be obtained by cutting the cube diagonally, as shown in FIG. 2A.

Figure 2E:
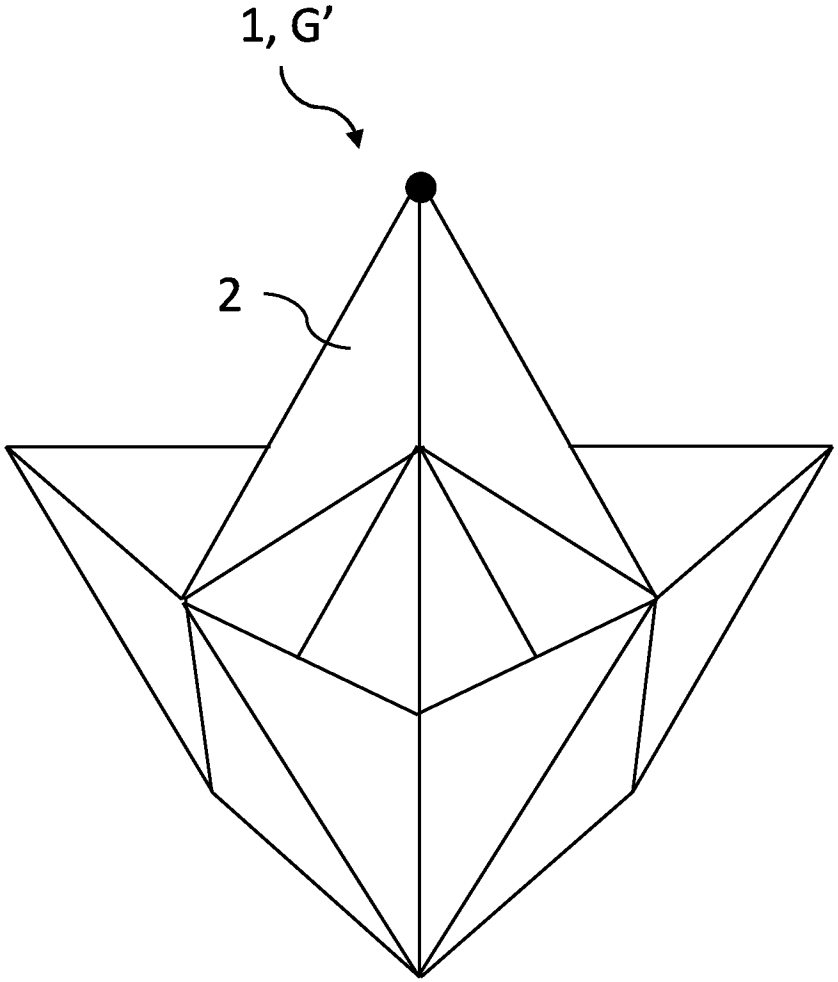
Figure 2D:
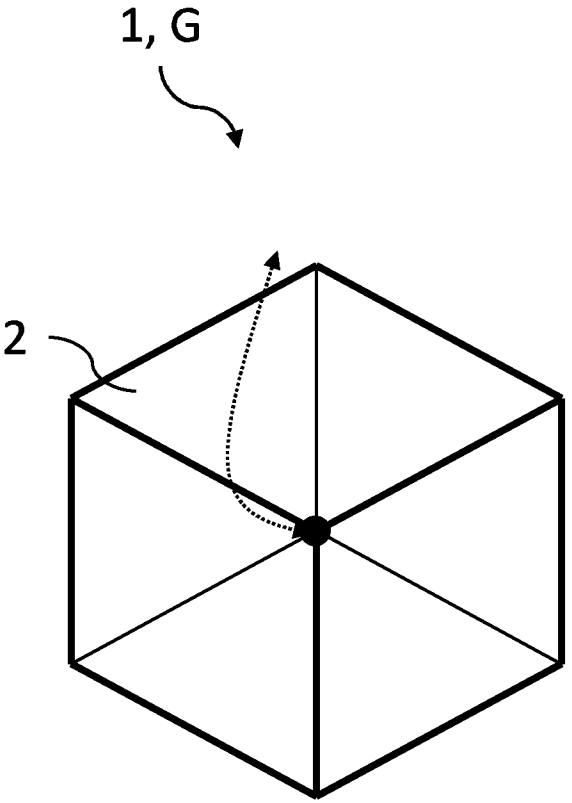

In FIG. 2D one initial geometric transformation G of the transformational toy 1 is shown, which has the shape of a cube. A second geometric transformation G' of the transformational toy 1 is shown in FIG. 2E. This second geometric transformation G' can be obtained from the initial cube when a corner of the cube is moved towards the opposite corner of the cube. As the different polyhedron bodies are pivotally coupled using hinges 30 provided by the connection strip 3, the polyhedron bodies cannot be moved independently from each other. If one polyhedron body 2 is moved, other polyhedron bodies will be moved as well. This allows to perform a full geometric transformation from G to G' of the transformable toy 1 with the movement of a limited number of polyhedron bodies 2.

FIGS. 2E-2K illustrate various other potential configurations for the transformational toy 1. With the specific positioning and orientation of the magnets 4 and the connection strip 3 as described below in detail, the transformational toy 1 can be maintained in any of the other potential configurations as disclosed and/or illustrated.

Figure 2G:
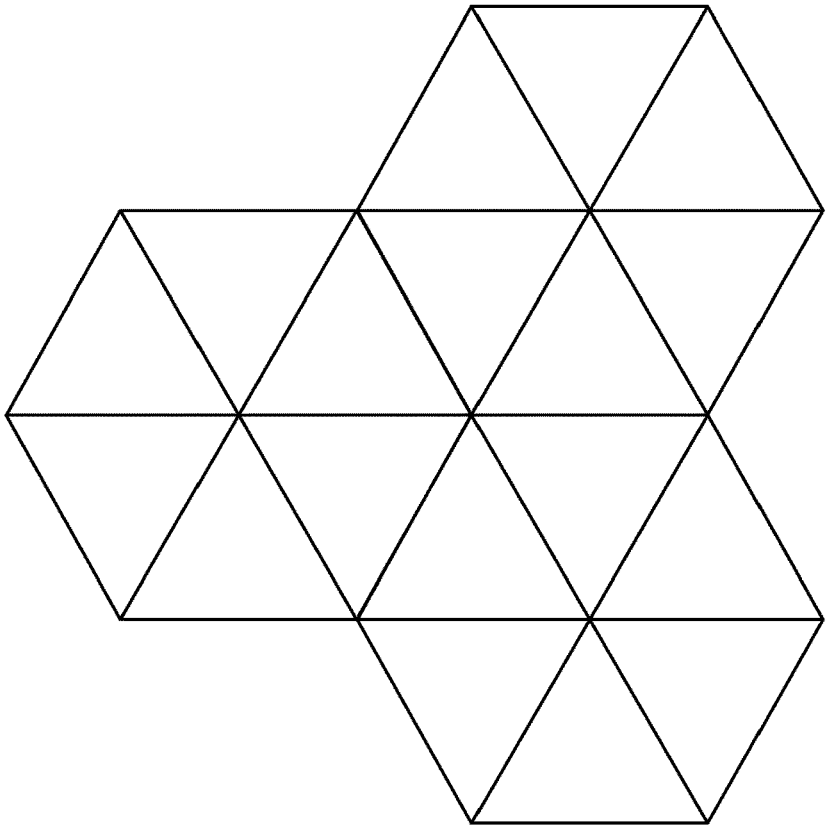
Figure 2F:
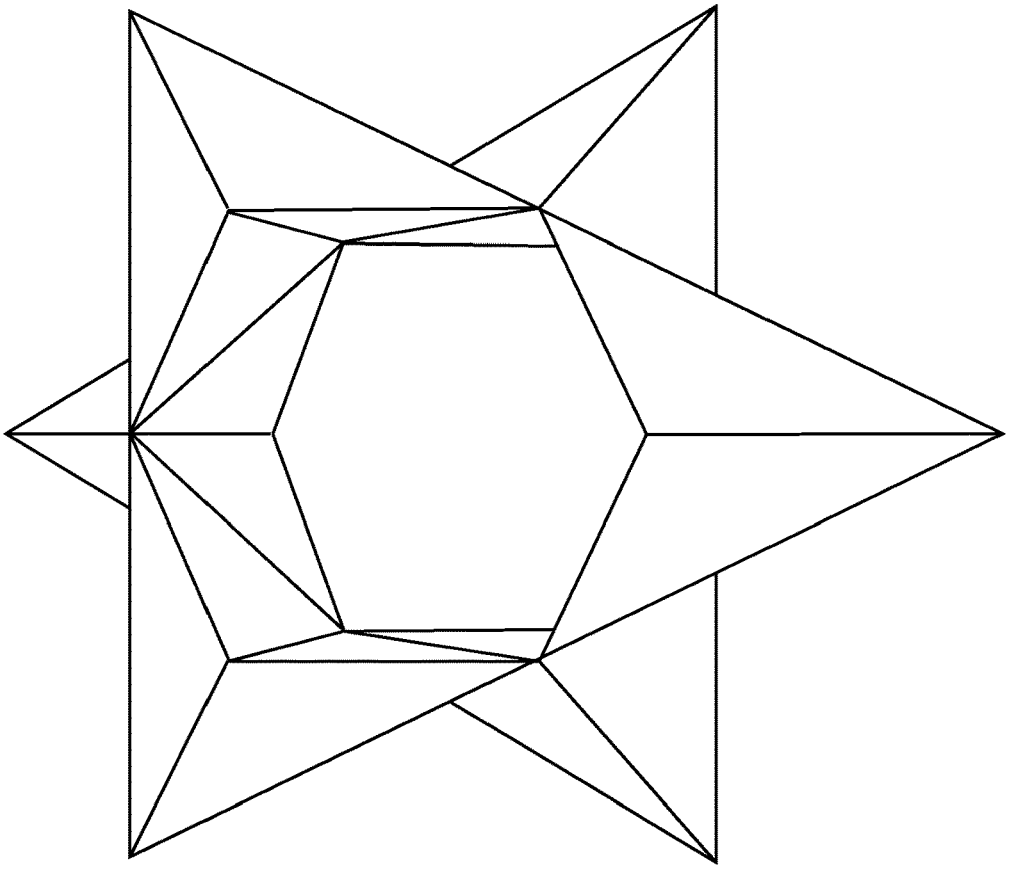
Figure 2I:
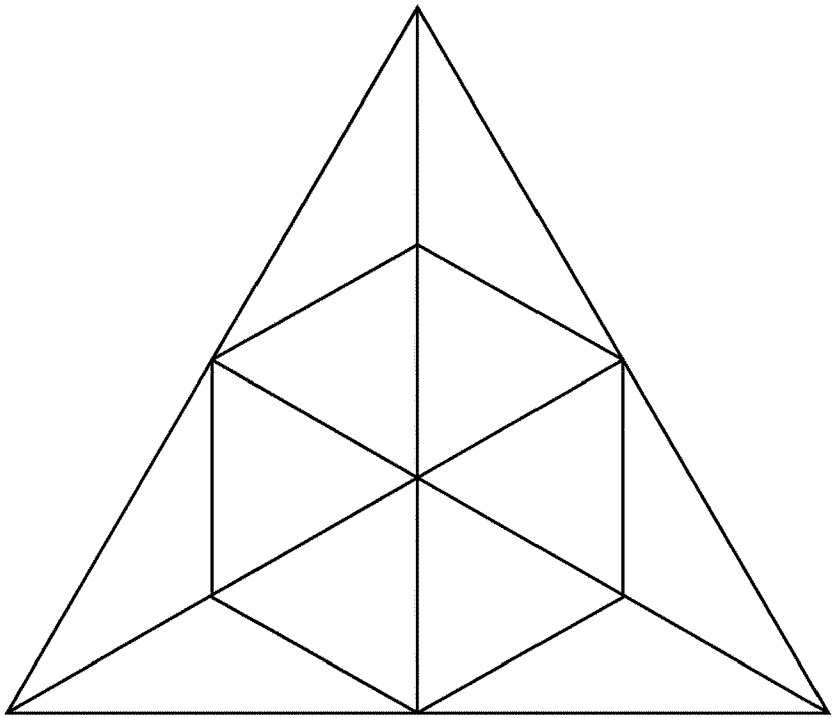
Figure 2H:
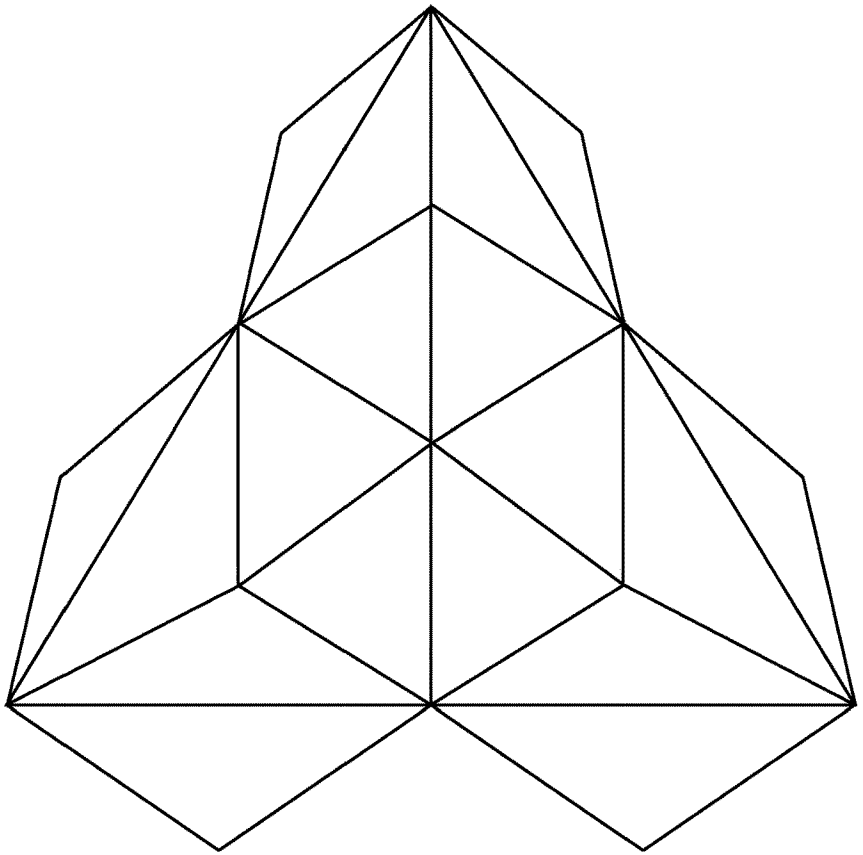
Figure 2K:
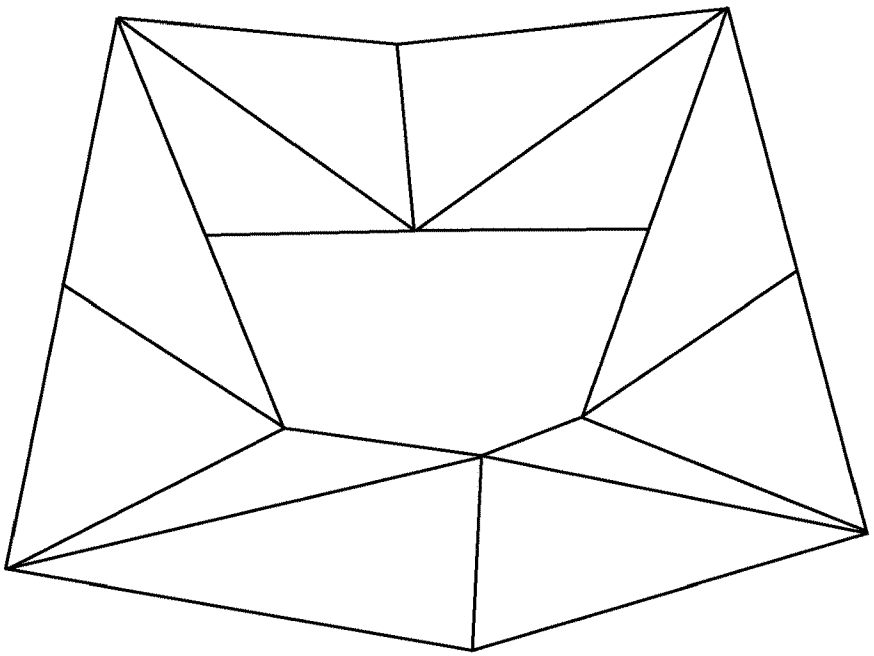
Figure 2J:
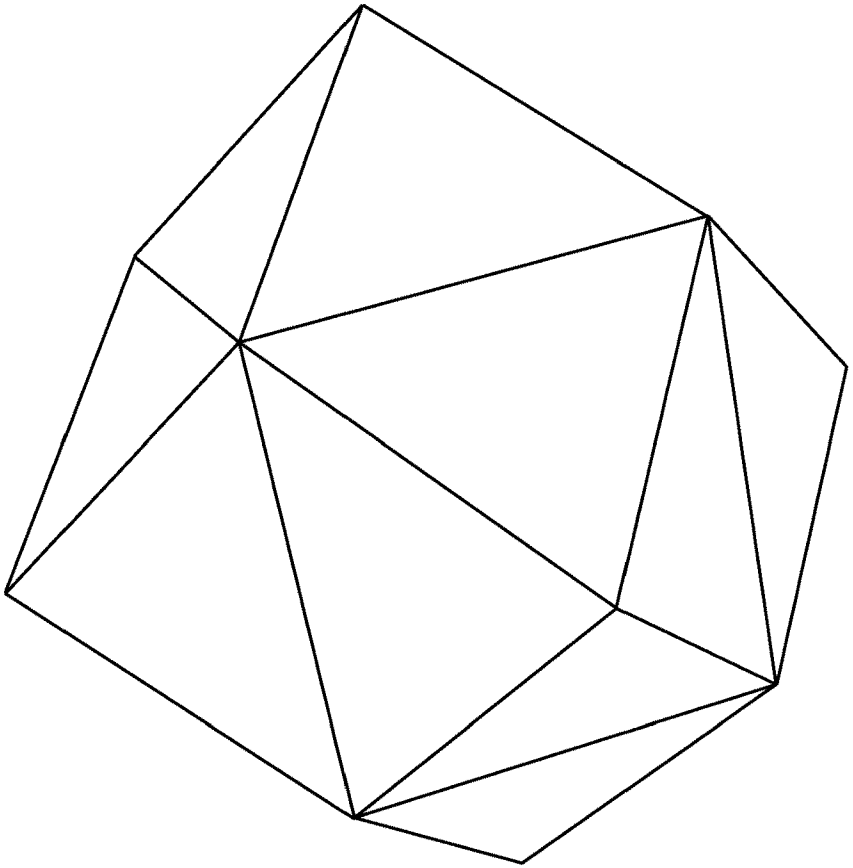

More particularly, FIG. 2F is a perspective view of the transformational toy 1 illustrated in FIG. 2A, the transformational toy 1 being in a third configuration; FIG. 2G is a perspective view of the transformational toy 1 illustrated in FIG. 2A, the transformational toy 1 being in a fourth configuration; FIG. 2H is a perspective view of the transformational toy 1 illustrated in FIG. 2A, the transformational toy 1 being in a fifth configuration; FIG. 2I is a perspective view of the transformational toy 1 illustrated in FIG. 2A, the transformational toy 1 being in a sixth configuration; FIG. 2J is a perspective view of the transformational toy 1 illustrated in FIG. 2A, the transformational toy 1 being in a seventh configuration; FIG. 2K is a perspective view of the transformational toy 1 illustrated in FIG. 2A, the transformational toy 1 being in an eighth configuration.

During use of the transformational toy 1, the individual polyhedron bodies 2 can be quickly and easily moved and manipulated relative to one another to enable the user to form the transformational toy 1 into any of the disclosed configurations. Moreover, as noted, the positioning, orientation and polarity of the magnets 4 within each of polyhedron body 2 enables the transformational toy 1 to be stably maintained in any such configurations. As such, the transformational toy 1 and the polyhedron bodies 2 can be viewed as an educational device for the study of polygonal solids, as a puzzle or toy that can be used for entertainment or amusement, and/or as a work of art that can be displayed for others to see.

In FIG. 3 different possible geometries of the polyhedron bodies 2 are shown. In FIG. 3A a polyhedron body 2 is shown which is obtained as shown in FIG. 2B. This polyhedron body 2 can be regarded as the outer limit or the outer boundaries for all other polyhedron bodies which can be used to produce a cuboidal transformational toy 1.

Figure 3A:
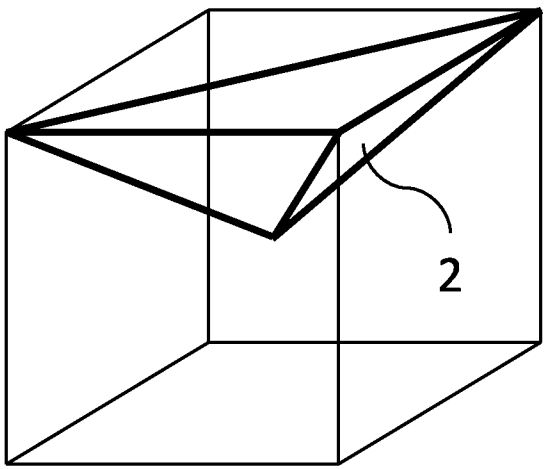
FIG. 3A, B, C, D, E schematic drawing of different polyhedron bodies.
Figure 3B:
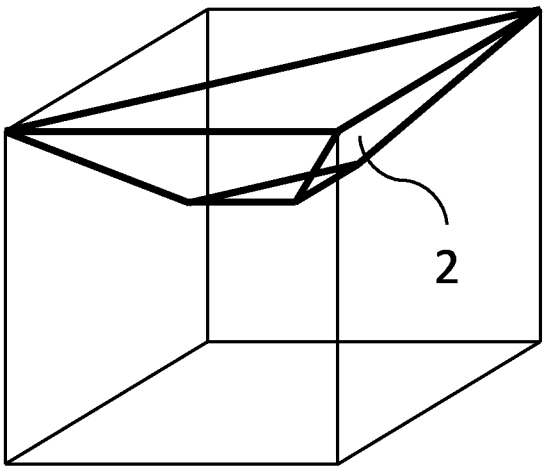
Figure 3C:
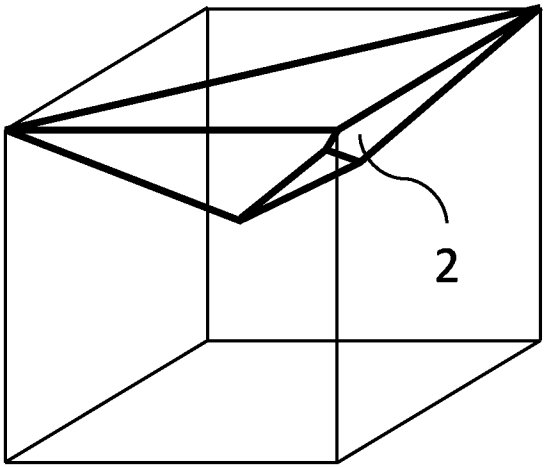

Another possible polyhedron body 2 is shown in FIG. 3B. It can be obtained by cutting off the tip of the polyhedron body 2 from FIG. 3A. The cutting plane can be parallel to the outer plane of the cube, however it can also be tilted as shown in FIG. 3C.

Figure 3D:
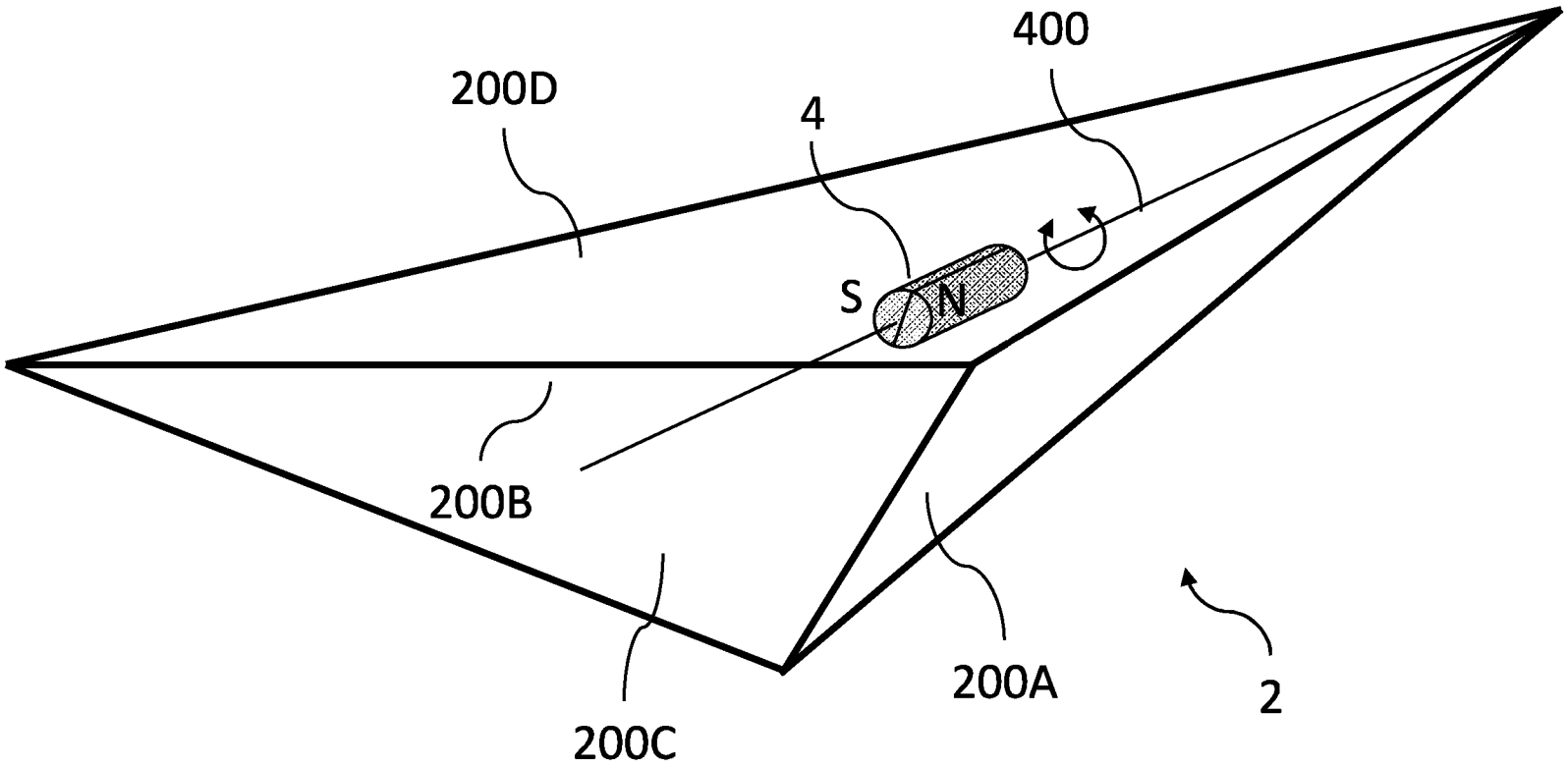
Figure 3E:
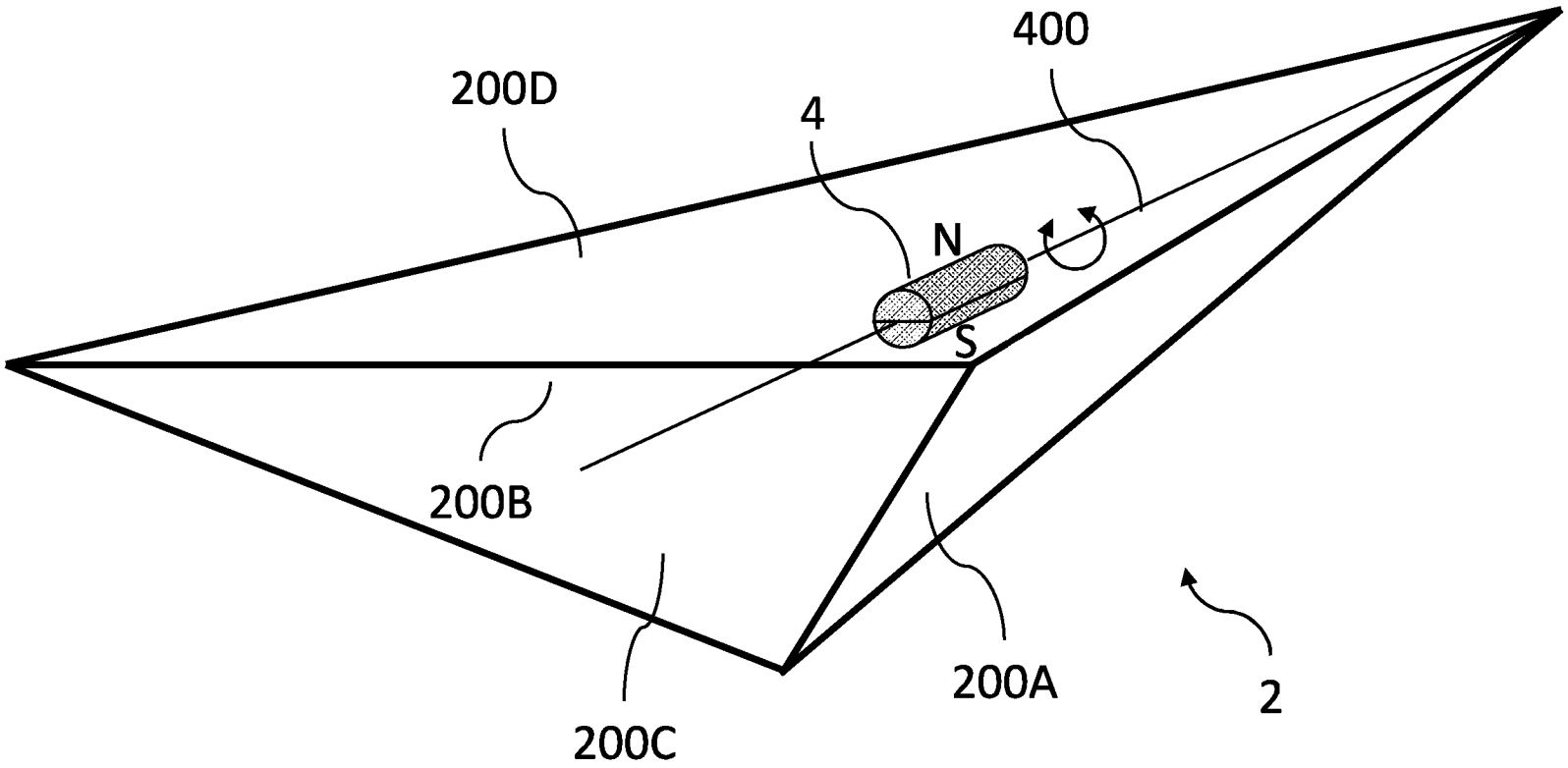

FIG. 3D, E schematically illustrate a representative embodiment of a polyhedron body 2 having a single moving magnet 4 that is diametrically magnetized. The polyhedron body 2 has four polygonal faces 200A, 200B, 200C, and 200D, with face 200 B hidden from the view. In some embodiments, the 200A and D faces (i.e., a first face and a fourth face) form a right angle relative to each other, with one of the 200A or 200D faces being relatively larger than the other, and the 200B and 200C faces being substantially the same size as each other. In the illustrated embodiment, the magnet 4 is positioned inside the polyhedron body 2 in such a manner that it can rotate about its longitudinal axis 400.

Generally, the magnet 4 is not permitted to move in an uncontrolled manner inside the polyhedron body 2. Rather, the polyhedron body 2 is provided with one or more internal structures, e.g., a cradle, a cord, a suspension, a gimbal or the like, that retain the moving magnet 4 adjacent to two or three faces while allowing the moving magnet 4 to move within a controlled region. For example, in some embodiments, the polyhedron body 2 is provided with an internal cradle, track, slot, compartment, cavity, support, and/or the like. Representative structures for enabling the magnet 4 to move within a controlled region are described below.

As shown in FIGS. 3D, E the moving magnet 4 is positioned adjacent to faces 200A and 200D such that it can move relative to the outer shell of the polyhedron body. In FIG. 3D, the north portion of the magnet 4 is adjacent to face 200A. By comparison, in FIG. 3E, the magnet 4 has rotated about the axis 400 such that the north portion is adjacent to face 200D. As a result of this movement of the magnet, both the north and south sides of the magnet 4 can be positioned adjacent to either face 200A or 200D. Accordingly, the magnet 4 can alternatingly exhibit a first polarity (e.g., a positive or negative polarity) through either face 200A or 200D. By "alternatingly," the present disclosure intends that the magnet 4 exhibits the first polarity through one face at a time. Advantageously, this enables a single moving magnet 4 to simulate a plurality of fixed magnets 4 as shown in FIG. 5A.

The embodiment of 3D and 3E is representative, not limiting. In some embodiments, the magnet 4 is a cylinder magnet, a disc magnet, a spherical magnet, or another magnet type. In some embodiments, the magnet 4 translates, shifts, slides, or tumbles relative to polygonal faces 200A-D in order to alternatingly exhibit the first polarity through face 200A or face 200B. In some embodiments, the magnet 4 rotates in more than one direction, e.g., in the case of a spherical magnet 4, about a center. This advantageously enables the magnet to alternatingly exhibit a polarity through more than two faces, e.g., three faces. In some embodiments, the magnet 4 is positioned adjacent to different faces, e.g., to adjacent to faces 200A and 200C, 200A and 200D, 200B and 200C, 200B and 200D, or 200D and 200C. In some embodiments, the magnet 4 is positioned adjacent to more than two faces, e.g., adjacent to faces 200A, 200B, and 200C. In some embodiments, the magnet 4 is positioned adjacent to a vertex where three faces meet (e.g., where faces 200A, 200B, and 200C meet).

In some embodiments, transformational toys 1 of the present disclosure include one or more moving-magnets 4 such as shown in FIGS. 3D, E, to provide enhanced entertainment, to reduce manufacturing cost, and/or for other benefit. In some embodiments, transformational toys 1 include two or more different types of moving magnets (e.g., a first type and a second type), each type having a different moving magnet configuration configured to alternatingly exhibit a magnet polarity through different faces. As shown above, in some embodiments, the moving magnets are arranged to enable a magnetic coupling of polyhedron bodies in one or more configurations, e.g., any one or more of the configurations shown in FIGS. 2D-2K.

Figure 4A:
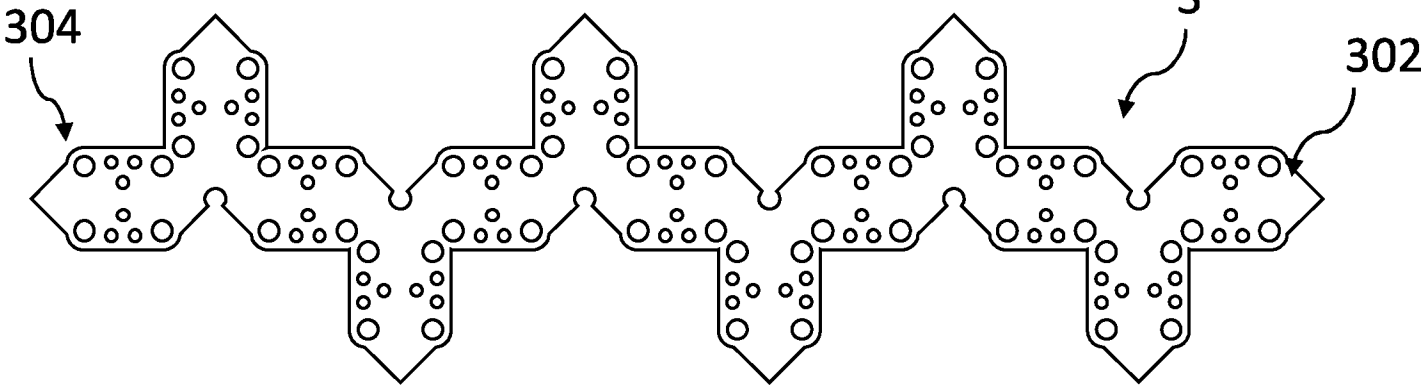
FIG. 4A, B, C, D, E schematic drawing of different connection strips.
Figure 4B:
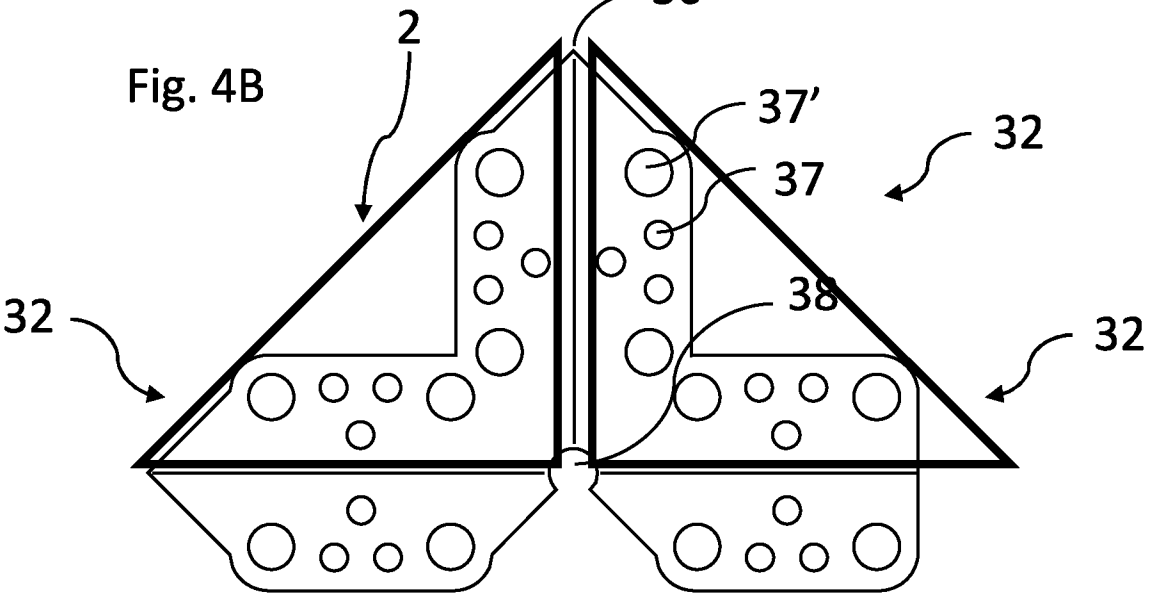

In FIG. 4A a connection strip 3 is shown, whereas FIG. 4B shows a detailed view on a portion 32 of the connection strip 3. The connection strip 3 is shaped in such a way that it allows to connect all twelve polyhedron bodies 2 and provide hinges 30 at all edges of a cube. Hence this particular connection strip 3 can be used for connecting all polyhedron bodies 2 of a cuboidal transformational toy 1.

Every portion 32 of the connection strip comprises openings 37 for positioning fixing pins 26 of the polyhedron bodies 2, as shown later. Furthermore, every portion 32 can comprise openings 37' for magnets 4, which are used to stabilize the current geometric transformation G of the transformational toy 1. The openings 37, 37' in the portion 32 of the connection strip 3 are located symmetrically to a symmetry axis, which will be used as the rotational axis of the hinge 30.

In FIG. 4B a very schematic representation of a footprint of a polyhedron body 2 in form of a flat, isosceles triangle is included which is intended to demonstrate the position of the polyhedron bodies 2 with respect to the connection strip 3. The shape of the polyhedron bodies 2 may, of course, vary and is to be understood as an example only.

In order to close the loop and to connect all polyhedron bodies in a closed-loop configuration, in one embodiment, the beginning portion 302 and the end portion 304 of the connection strip 3 are placed on top of each other and are connected by means of a polyhedron body 2 connected to the connection strip 3 in the manner as described below with reference to FIG. 5A. In other words, closing the loop does not require the connection strip 3 to be loop-shaped but a linear connection strip 3 suffices which will be connected on both ends to form the loop-configuration for the polyhedron bodies 2 to form a kaleidocycle.

The connection strip 3 can be made of leather or flexible plastic, which allows the portion 32 of the connection strip 3 to be bent around the symmetry axis. The material can withstand this mechanical stress without breaking, cracking or becoming brittle during the lifetime of the transformational toy 1.

To further prevent any damage due to mechanical stress, a fraying-prevention hole 38 is inserted to strongly stressed areas of the connection strip. In this way a propagation of a crack or a tear along the direction of the hinge 30 will be prevented.

Figure 4C:
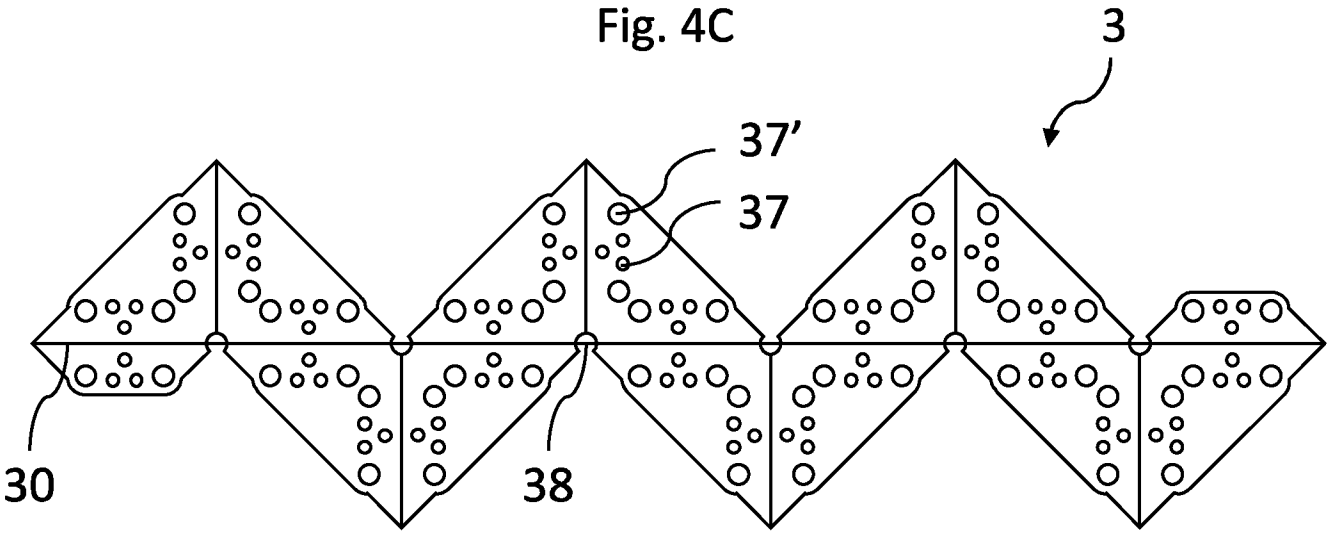

In FIG. 4C another embodiment of a connection strip 3 is shown. The connection strip 3 provides for example the same arrangement of openings 37, 37' as in FIG. 4A.

However, the connection strip 3 comprises a larger surface area, which allows for a more secure connection of the polyhedron bodies 2.

Figure 4D:
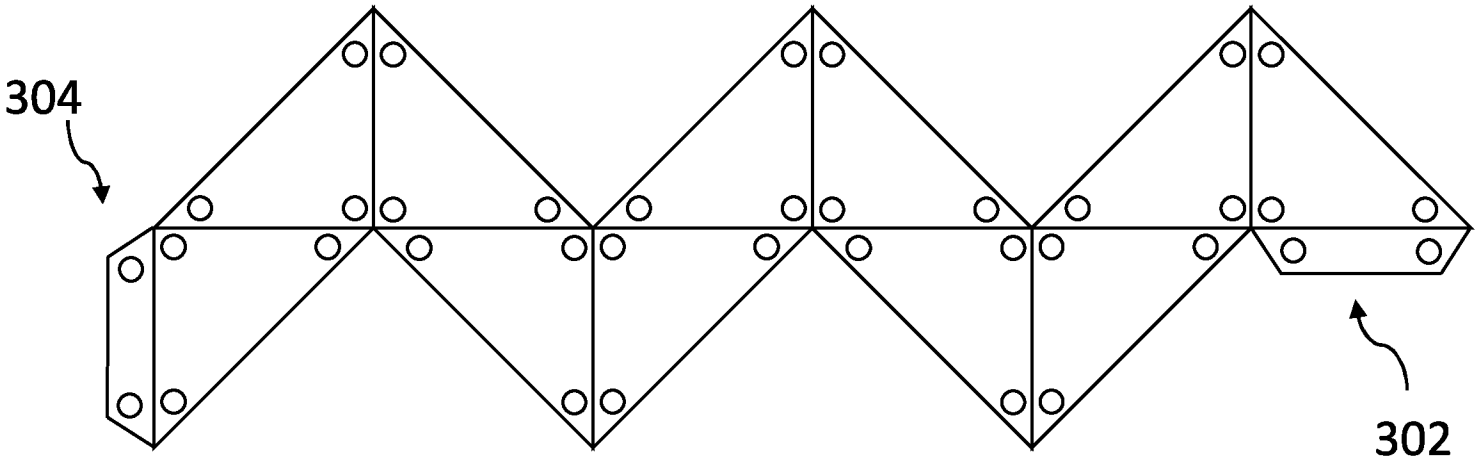
Figure 4E:
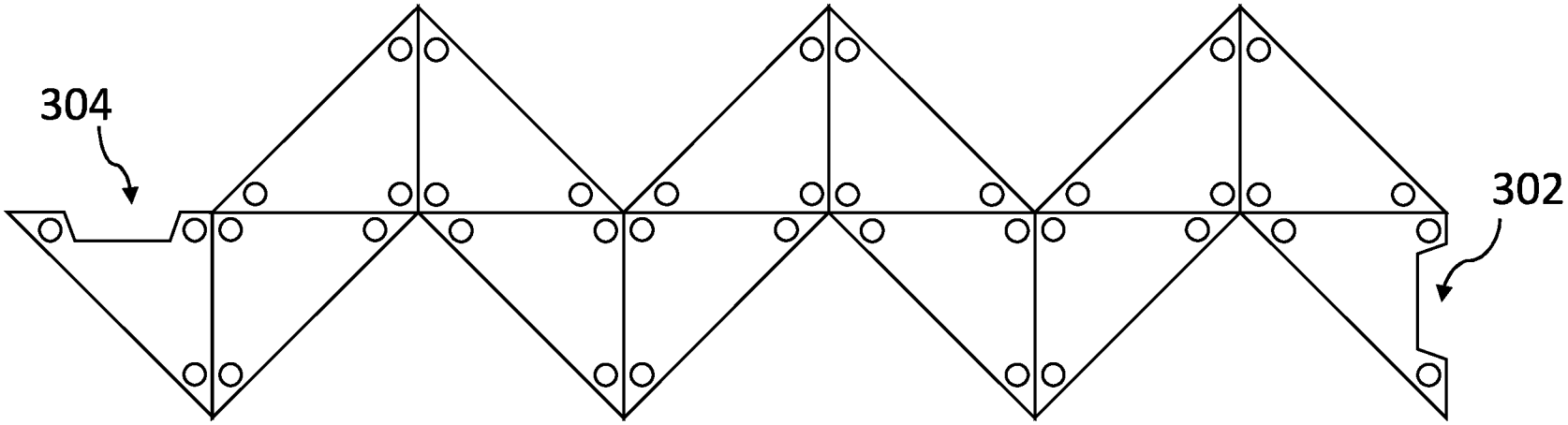

In FIGS. 4D and 4E yet embodiments of a connection strip 3 are shown which are similar to the one shown in FIG. 4A but the beginning portion 302 and the end portion 304 are shaped such that a loop can be closed in a manner in which the beginning portion 302 and the end portion 304 can be placed with a reduced overlap. The connection between the beginning portion 302 and the end portion 304 is effected again by two polyhedron bodies which connect the two portions together like a chain joint. Note that only the openings 37' are shown as a guide to the eye. The connection strip 3 can comprise openings 37 as well.

Figure 5C:
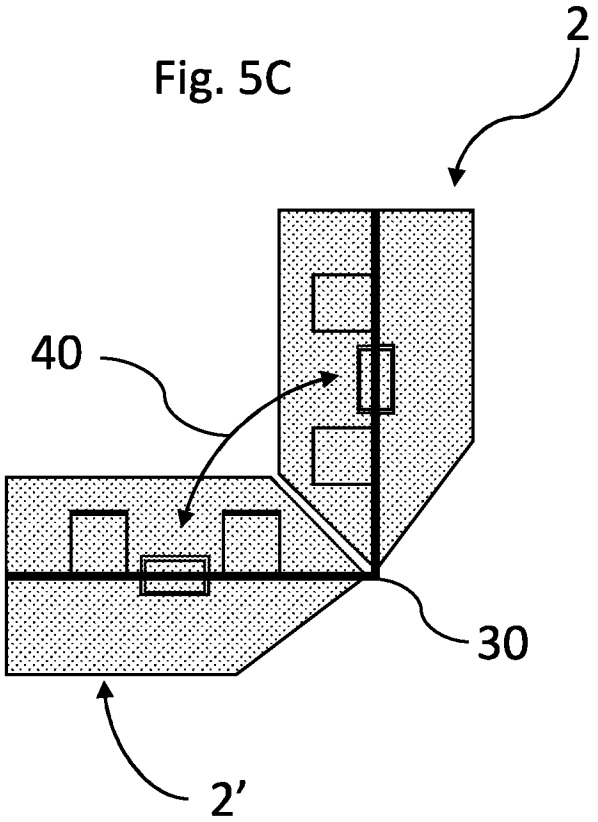
Figure 5B:
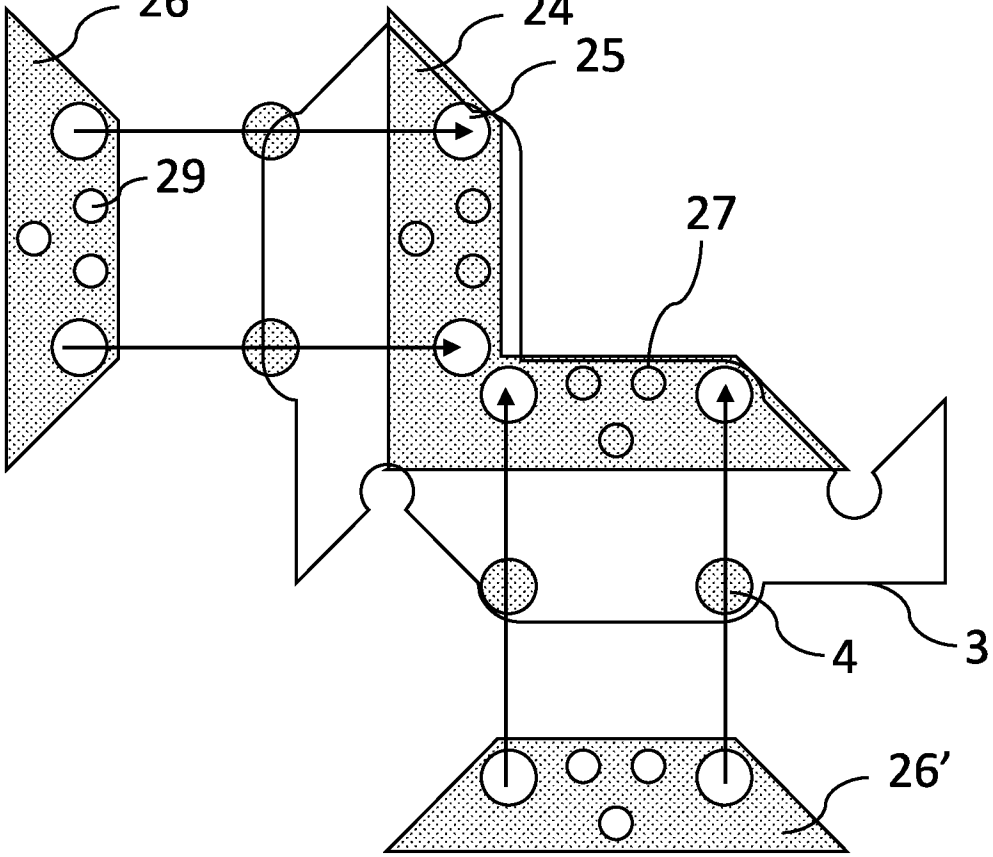

In FIG. 5A, 5B it is shown how the polyhedron bodies 2, 2' can be fixed to the connection strip 3. Every polyhedron body 2, 2' comprises two connectable parts 24, 26. The connection is realized using pins 27 and holes 29, where the pins of one connectable part 24, 26 can be inserted into the respective hole 29 in the corresponding connectable part 26, 24. The pins 27 can be interlocked in the holes 29 or glued into the holes 29 or can be locked in the holes 29 due to friction between the outer surface of the pin 27 an the inner surface of the hole 29. Furthermore, the connectable parts can comprise cavities 25 into which a magnet 4 can be inserted in order to stabilize the geometric transformations of the transformational toy 1.

The pins 27 and holes 29 and cavities 25 of the connectable parts 24, 26 are arranged in such a manner that the pins 27 can be placed through the openings 37, 37' of the connections connection strip 3. Furthermore, the openings 37' in the connection strip 3 allow the magnet 4 to be placed in the center of the polyhedron body. This is advantageous for the stabilization mechanism of the geometric transformations, as the magnet can be placed in the center of mass of the polyhedron body 2.

The connectable parts 24, 26 of the first polyhedron body 2 are connected to each other using the aforementioned pins 27 and holes 29 where they enclose a first half 320 of the first portion 32 of the connection strip 3. The second half 322 of the first portion 32 of the connection strip 3 is enclosed by the connectable parts 24', 26' of a second polyhedron body 2'. The first and second polyhedron bodies 2, 2' lie adjacent to each other, where the connection edge 28 of the first polyhedron body 2 is parallel to the connection edge 28' of the second connection body 2'. The connection edges 28, 28' can touch each other, however, they can also be positioned in a slight distance of for example less than 5 mm. In this way the connection strip 3 is barely visible, but the length scale is small enough to provide a stable rotation of the polyhedron bodies 2, 2' around the rotation axis of the hinge 30, which is provided by the connection strip 3.

In other words, each polyhedron body 2 is composed of at least two connectable parts 24, 26 and the connection strip 3 is placed between the connectable parts 24, 26.

A hinge 30 between a first and a second polyhedron body 2, 2' is formed by inserting a first half of a first portion of the connection strip 320 between the two connectable parts 24, 26 of the first polyhedron body 2 and a second half of the first portion of the connection strip 322 between the two connectable parts 24', 26' of the second polyhedron body 2'. Accordingly, the connecting edge 28 of the first polyhedron body 2' and the connecting edge 28' of the second polyhedron body 2' lie adjacent to each other and are pivotably connected by the first portion 32 of the connection strip 3.

In FIG. 5C a geometric transformation is shown, where the polyhedron bodies 2, 2' are rotated towards each other about the rotation axis provide by the hinge 30. In other words, the connection strip 3 provides a hinge 30 about which the polyhedron bodies 2, 2' can be rotated.

The magnets 4 in the polyhedron bodies 2, 2' provide a magnetic field 40, which can stabilize the geometric transformation G when the magnetic force between the magnets 4 is attractive. When the magnetic force is repellent the geometric transformation is not stabilized and the polyhedron bodies 2, 2' will try rotated in order to increase the distance between the magnets 4.

Figure 5D:
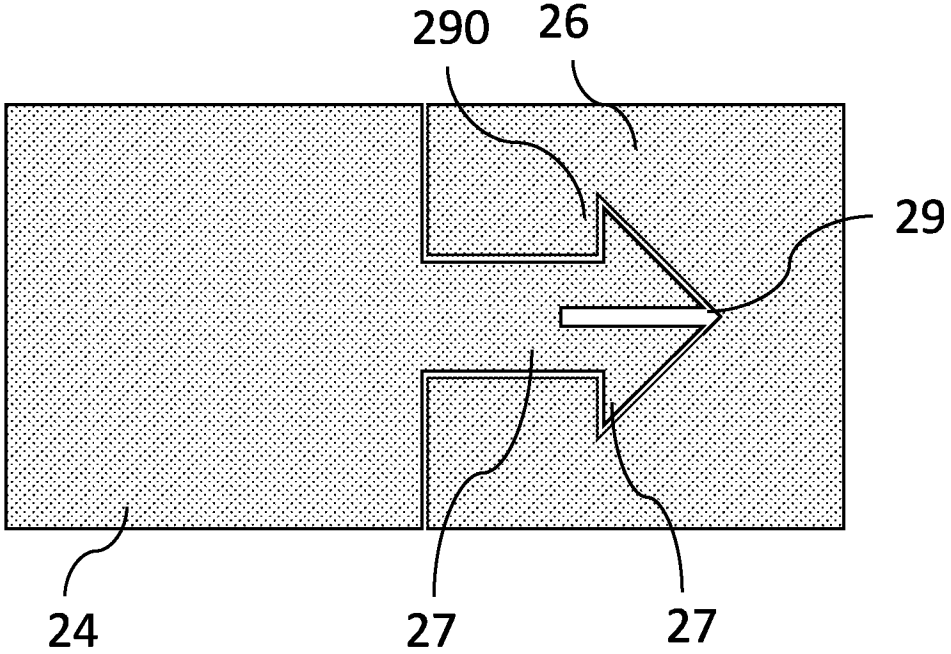
Figure 5F:
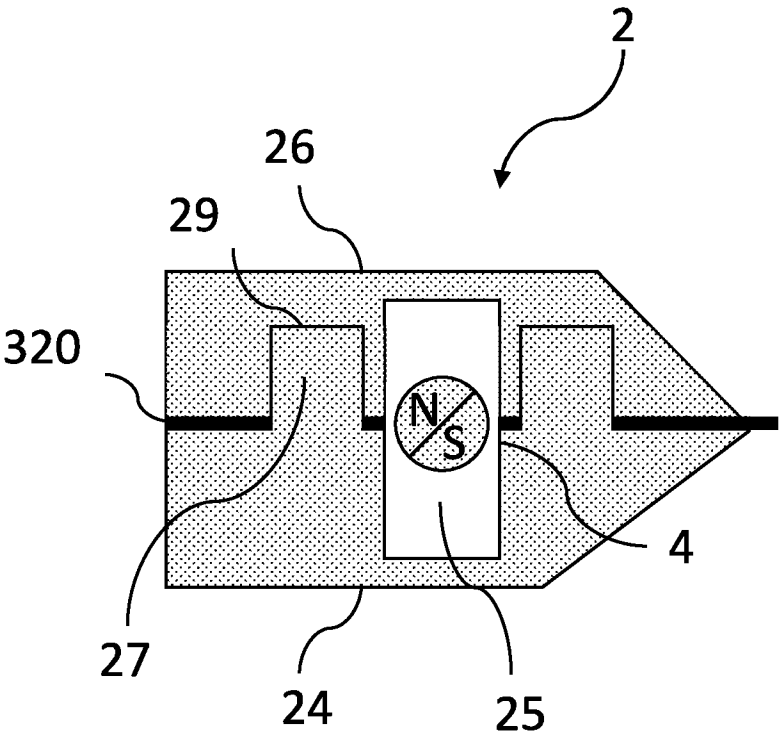

In FIG. 5D another possible fixation mechanism between the connectable parts 24, 26 is shown. A snap-in connection can be used, where the pin 27 comprises a hook-like structure 270 which can be locked with the protrusion 290 of the hole.

Figure 5E:
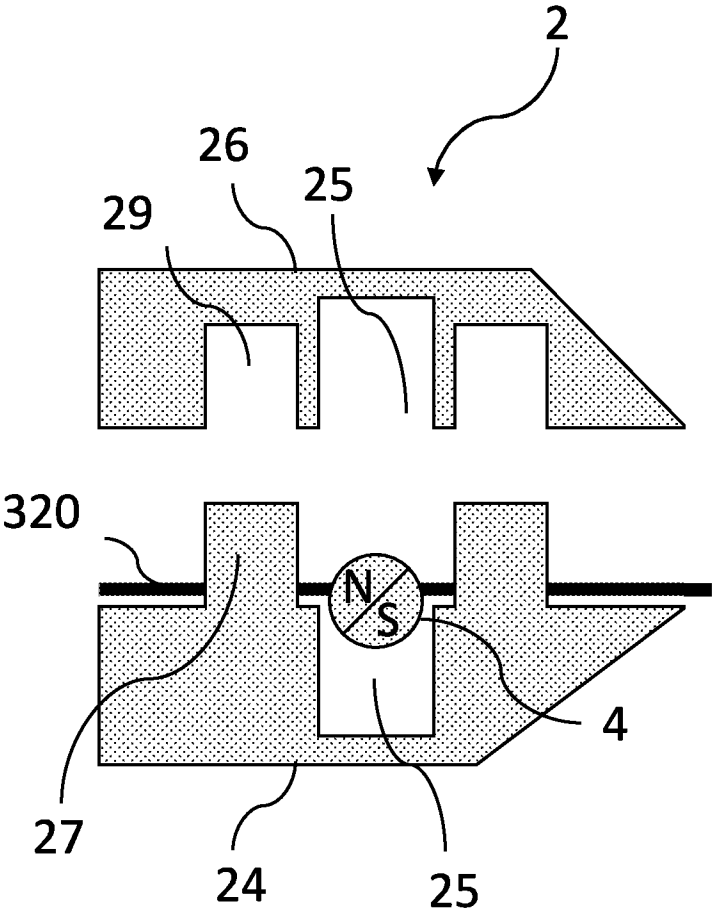

In FIG. 5E, F an embodiment of the disclosure is schematically shown, where the magnet 4 can move within the cavity 25, which is formed by the connectable parts 24, 26. The cavity 25 has for example a tubular shape, where the length of the cavity 25 perpendicular to the plane of the connection strip 32 is much larger than the size of the magnet 4. This allows the magnet 4 to move in the direction perpendicular to the plane of the connection strip 32. For example, the magnet 4 can have a spherical shape such that it can roll towards the ends of the cavity 25, where the magnet 4 can then align its magnetic field 40 according to the surrounding magnetic fields from the transformational toy 1.

However, the magnet 4 can also have a cylindrical form, such that it also can move in the direction perpendicular to the plane of the connection strip 32. Furthermore, a cylindrical magnet 4 can be polarized along the length direction of the cavity. The movement of the magnet then only regulates the field strength through as least one polygonal face 200 of the polyhedron body. Alternatively, the cylindrical magnet 4 can be polarized perpendicularly to the length direction of the cavity 25. With this the magnet 4 also has a rotational degree of freedom, which allows the magnet 4 to align its magnetic field 40 according to the surrounding magnetic field of the transformational toy 1.

Figure 6:
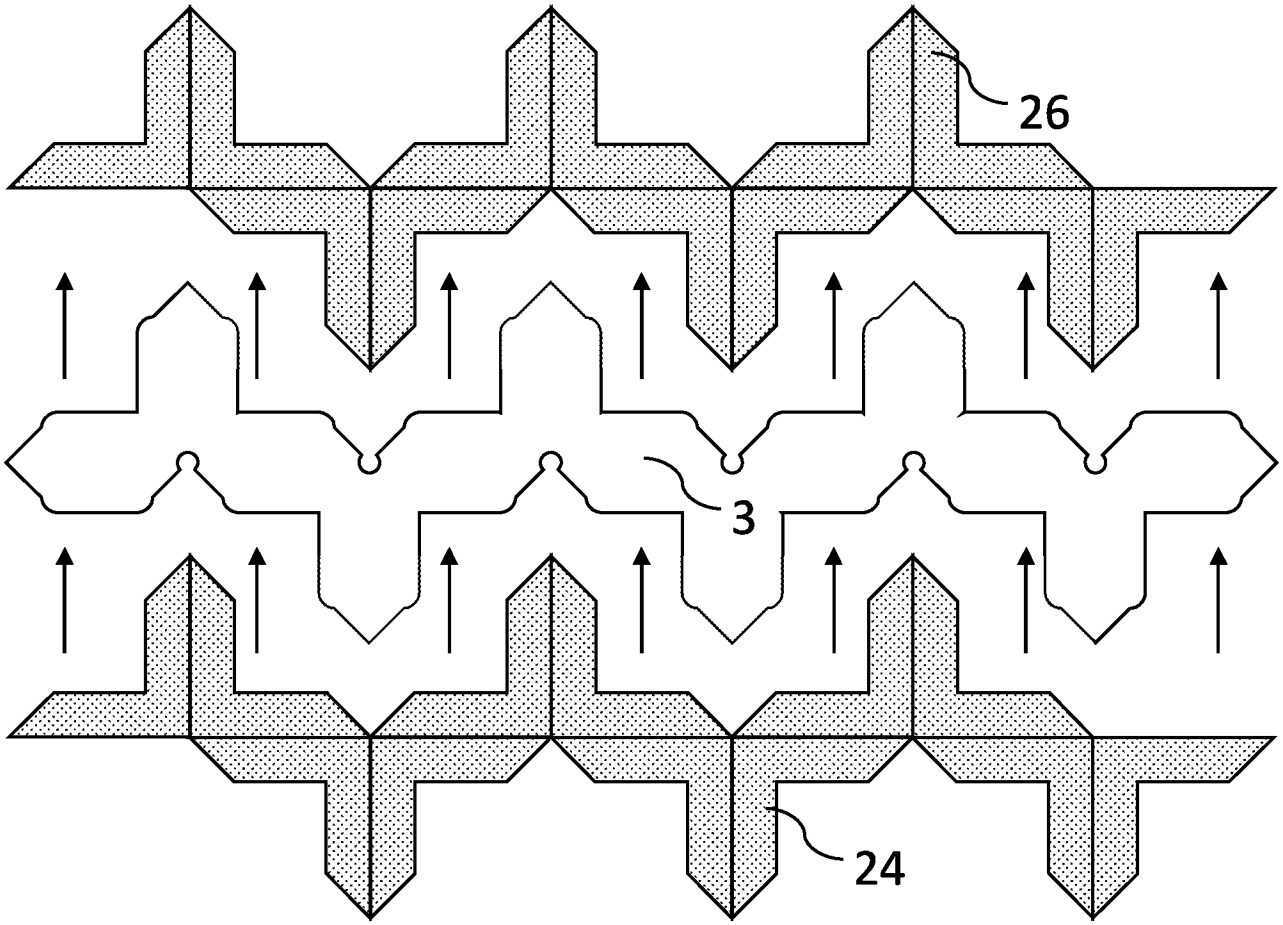
FIG. 6 schematic drawing of the attachment of polyhedron bodies to the connection strip to build a transformational toy.

In FIG. 6 it is shown that all connectable parts 24, 26 of the polyhedron bodies 2 are connected to one single connection strip 3. In this way the connection strip provides a base to which all polyhedron bodies 2 can be attached. Only at the final production stage, the first and the last polyhedron bodies 2 in the shown chain of polyhedron bodies 2 are connected to each other. This allows to speed up the production process of the transformational toy 1. By connecting the first and last polyhedron body 2 of the polyhedron body chain, transformational toy 1 forms.

As far as applicable, all individual features shown in the embodiments can be combined and/or exchanged without leaving the field of the invention.

LIST OF REFERENCE NUMERALS

1 transformational toy
2 polyhedron body
20, 22 adjacent polyhedron bodies
200 polygonal face
24 first connectable part
25 magnet cavity
26 second connectable part
27 pin
270 hook
28 connection edge
29 hole

290 protrusion
3 connection strip
30 hinge
32 portion of the connection strip
320 first half of portion
322 second half of portion
37 opening
38 frying-prevention hole
4 magnet
40 magnetic field
G, G' geometric transformations
R rotation axis
R* ring axis

The invention claimed is:

1. A transformational toy, comprising:

at least six polyhedron bodies;

a single connection strip connecting the at least six polyhedron bodies in a chain, wherein the single connection strip forms a plurality of hinges comprising a hinge between every pair of adjacent polyhedron bodies of the chain, wherein the plurality of hinges facilitates movement of the at least six polyhedron bodies between at least two different geometric transformations; and a plurality of magnets configured to stabilize the at least six polyhedron bodies in the at least two different geometric transformations.

2. The transformational toy according to claim 1, wherein the at least six polyhedron bodies are connected in a closed loop configuration by the single connection strip.

3. The transformational toy according to claim 1, wherein the at least six polyhedron bodies comprise twelve polyhedron bodies.

4. The transformational toy according to claim 1, wherein the single connection strip has a beginning portion and an end portion connected by one of the at least six polyhedron bodies.

5. The transformational toy according to claim 1, wherein two connectable parts of at least one of the at least six polyhedron bodies enclose the single connection strip.

6. A transformational toy, comprising:

at least six polyhedron bodies;

at least one connection strip connecting the at least six polyhedron bodies in a loop, wherein the at least one connection strip forms a hinge between every pair of adjacent polyhedron bodies of the loop;

wherein each polyhedron body of the at least six polyhedron bodies comprises two connectable parts and the at least one connection strip is between the two connectable parts of each of the at least six polyhedron bodies, and wherein a beginning portion of the at least one connection strip and an end portion of the at least one connection strip are disposed between the two connectable parts of one of the at least six polyhedron bodies.

7. The transformational toy according to claim 6, wherein a hinge between a first polyhedron body and a second polyhedron body of the at least six polyhedron bodies is formed by a first portion of the at least one connection strip disposed between the two connectable parts of the first polyhedron body and a second portion of the at least one connection strip disposed between the two connectable parts of the second polyhedron body, wherein a connecting edge of the first polyhedron body and a connecting edge of the second polyhedron body lie adjacent to each other and are pivotably connected by the at least one connection strip.

8. The transformational toy according to claim 6, wherein the two connectable parts comprise connection strip fixing parts.

9. The transformational toy according to claim 8, wherein the connection strip fixing parts comprise pins and holes.

10. The transformational toy according to claim 6, wherein the at least one connection strip comprises a single connection strip.

11. The transformational toy according to claim 1, wherein the at least six polyhedron bodies comprise twelve tetrahedron bodies.

12. The transformational toy according to claim 1, wherein each of the at least six polyhedron bodies comprises at least one magnet of the plurality of magnets.

13. The transformational toy according to claim 6, further comprising a plurality of magnets configured to stabilize the at least six polyhedron bodies.

* * * * *